US005501182A

United States Patent [19]

Kull et al.

[11] Patent Number: 5,501,182

[45] Date of Patent: Mar. 26, 1996

[54] PERISTALTIC VANE DEVICE FOR ENGINES AND PUMPS

[76] Inventors: Leo Kull; Raivo L. Kull, both of 58 Westover Ave., W. Caldwell, N.J. 07006

[21] Appl. No.: 502,964

[22] Filed: Jul. 17, 1995

[51] Int. Cl.[6] ..... F02B 53/00

[52] U.S. Cl. ..... 123/18 R; 417/481

[58] Field of Search ..... 417/481, 486; 123/18 R

[56] References Cited

U.S. PATENT DOCUMENTS

| | | | |
|---|---|---|---|
| 1,955,148 | 4/1934 | Robertson et al. | 123/18 R |
| 4,005,687 | 2/1977 | Jonathan | 123/289 |
| 4,027,475 | 6/1977 | Folsom | 417/481 |
| 4,029,060 | 6/1977 | Dane | 123/18 R |
| 4,445,826 | 5/1984 | Tarr | 417/476 |
| 4,568,255 | 2/1986 | Lavender et al. | 417/477.8 |
| 5,074,253 | 12/1991 | Dettwiler | 123/18 R |
| 5,152,254 | 10/1992 | Sakita | 123/18 R |
| 5,363,813 | 11/1994 | Paarlberg | 123/18 R |

FOREIGN PATENT DOCUMENTS

| | | | |
|---|---|---|---|
| 3-23383 | 1/1991 | Japan | 417/481 |
| 914811 | 3/1982 | U.S.S.R. | 417/481 |

*Primary Examiner*—David A. Okonsky

[57] ABSTRACT

A tabulated kinematic control theory provides a foundation for a variety of peristaltic motion control versions where a control stator establishes a reference line for a peristaltic control wave or path in few different ways for the purpose of making a control point on a differential linkage or gear to follow this control path which in turn is creating an alternating harmonic-motion-like accelerating and decelerating rotary motion to a pair of concentric rotor shafts which are attached to vane carriers with one or more vanes each. The vanes are working in a main cylindrical central-axis rotating or stationary pressure chamber whereby the accelerating and decelerating rotary motion of vanes is creating variable volume subchambers between adjacent vanes to provide a peristaltic flow of fluids through a pattern of inlet and outlet ports in a stationary distributing stator which has a registered relationship with the control stator for providing a synchronized communication between the variable volume subchambers and the inlet-outlet ports or any other communicating points. The positively controlled differential power transmission between the two rotor shafts and the operating shaft offers two operating modes: when the operating shaft functions as a power input shaft, the device will operate as a pump or compressor or when an external or internal pressure is applied to a closed subchamber, the variable peristaltic motion of vanes is transmitting the fluid pressure to a uniform rotation of the operating shaft which will function then as a power output shaft for an external pressure steam or fluid power engine or for an internal combustion engine of any kind.

26 Claims, 8 Drawing Sheets

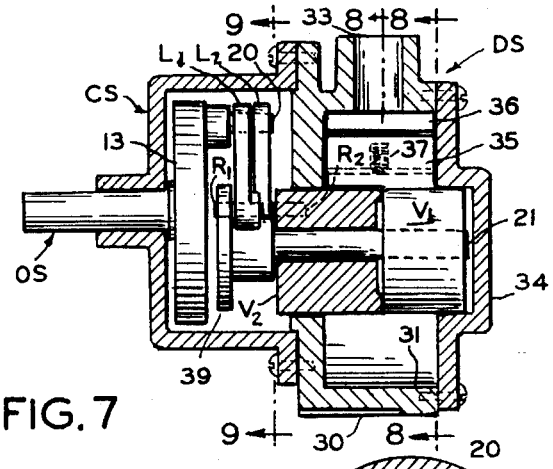
FIG. 7
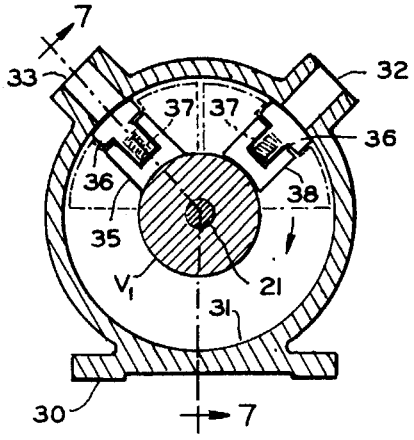
FIG. 8
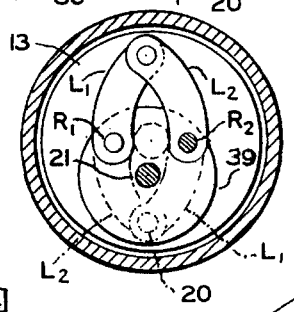
FIG. 9
FIG. 10
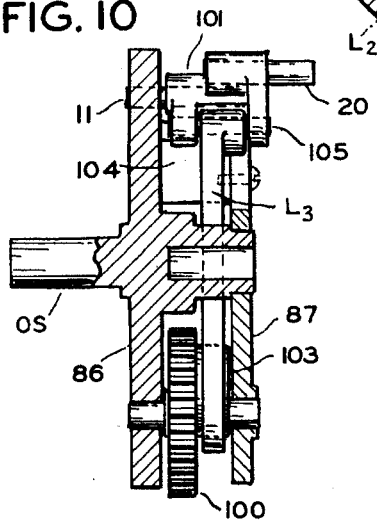
FIG. 11
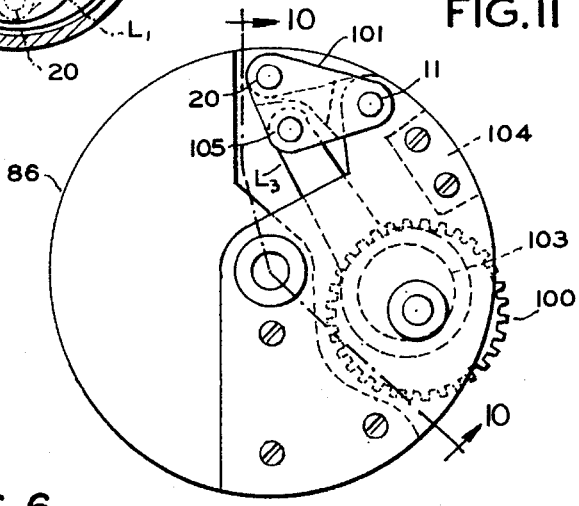
FIG. 6
| ILLUSTRATED IN FIGURES → | | | 4,7 | 1,2,12 | 11 | 3,26,37 | — | — | FROM N |
|---|---|---|---|---|---|---|---|---|---|
| 1 | VANES ON EACH ROTOR N | | 1 | 2 | 3 | 4 | 5 | 6 | N < INF. |
| 2 | VANES IN A MODEL | | 2 | 4 | 6 | 8 | 10 | 12 | 2N < INF. |
| 3 | α — NOMINAL | | 90° | 45° | 30° | 22.5° | 18° | 15° | 90°:N>0 |
| 4 | PERIST. STEP-NOMINAL | | 180° | 90° | 60° | 45° | 36° | 30° | 2α > 0 |
| 5 | PERISTALTIC WAVE SHAPE | | (8) | (o) | △ | □ | ⬠ | ⬡ | POLYG. < |
| CONTROL GEAR RATIOS | 6 | REVERSE | — | 1:1 | 2:1 | 3:1 | 4:1 | 5:1 | (N-1):1 |
| | 7 | UNIDIRECTIONAL | — | 3:1 | 4:1 | 5:1 | 6:1 | 7:1 | (N+1):1 |
| | 8 | ORBITING CRANK | — | 2:1 | 3:1 | 4:1 | 5:1 | 6:1 | N:1 < INF. |
| | 9 | FROM α = 90° | ↳ | 2:1 | 3:1 | 4:1 | 5:1 | 6:1 | N:1 < INF. |
| DISPLACEMENT FACTOR F | 10 | INT. COMB. ENG. | — | 1 | — | 2 | — | 3 | N:2 < INF. |
| | 11 | EXT. COMB. ENG. | 1 | 2 | 3 | 4 | 5 | 6 | N < INF. |

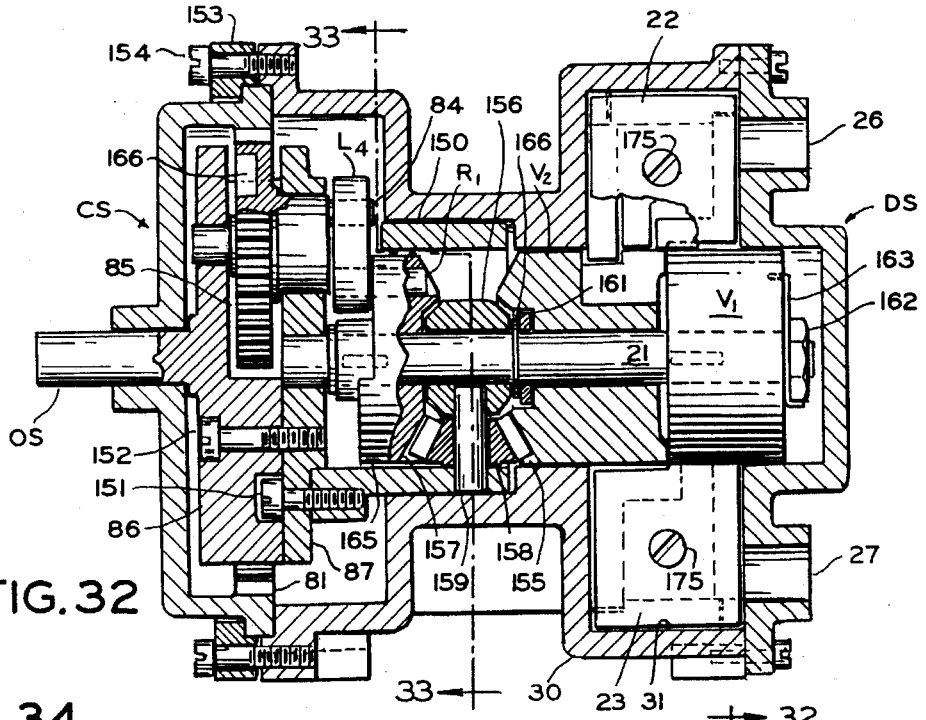
FIG. 32
FIG. 34
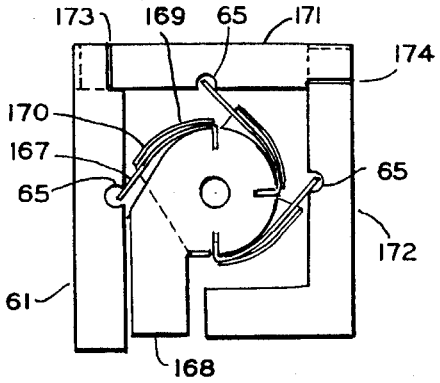
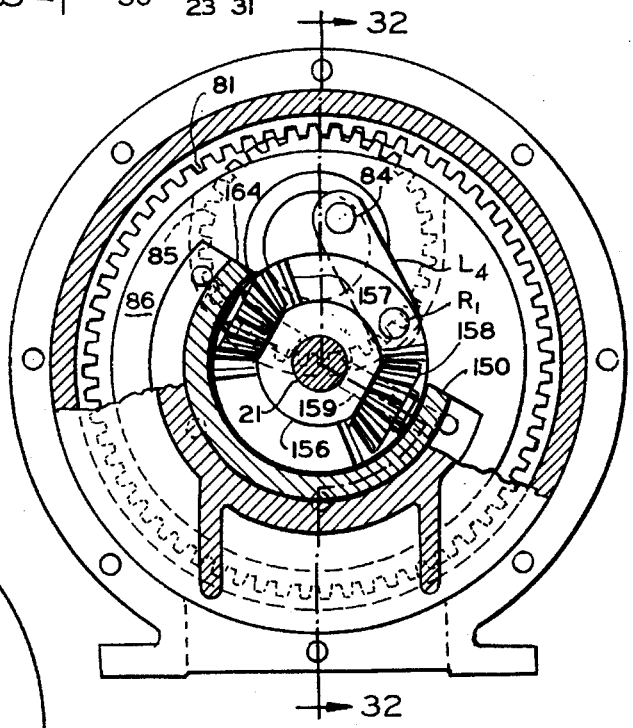
FIG. 33
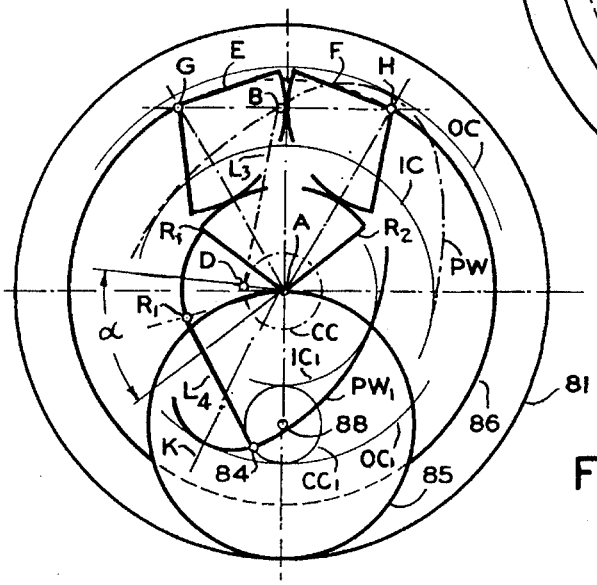
FIG. 31

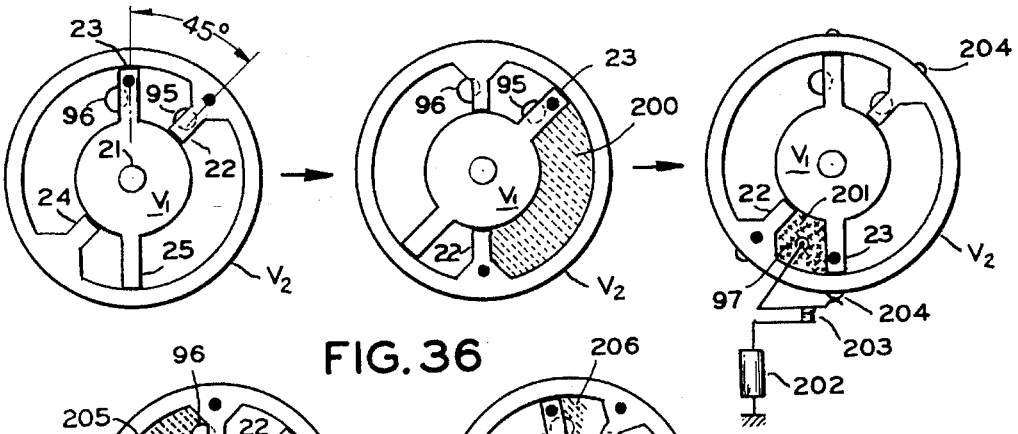
FIG. 36
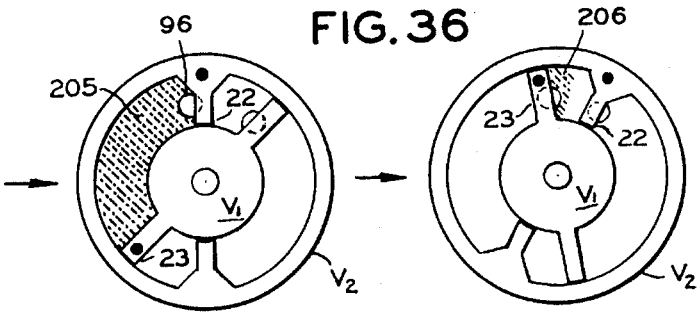
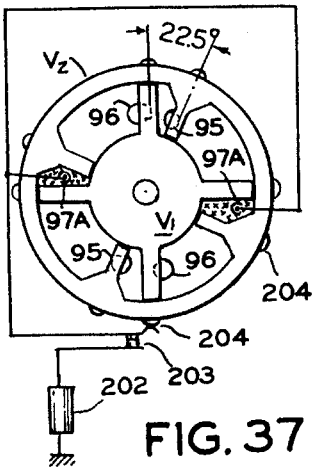
FIG. 37
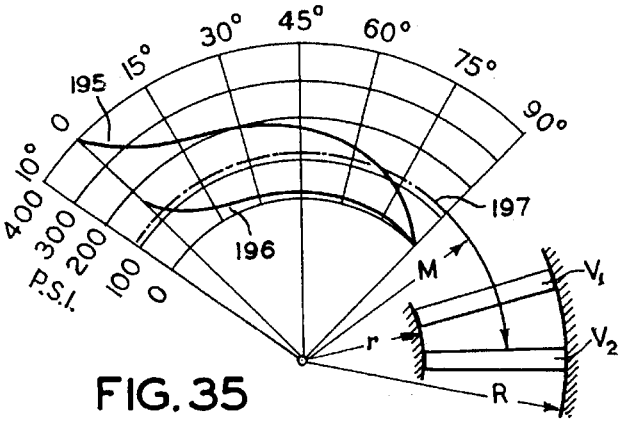
FIG. 35
FIG. 38
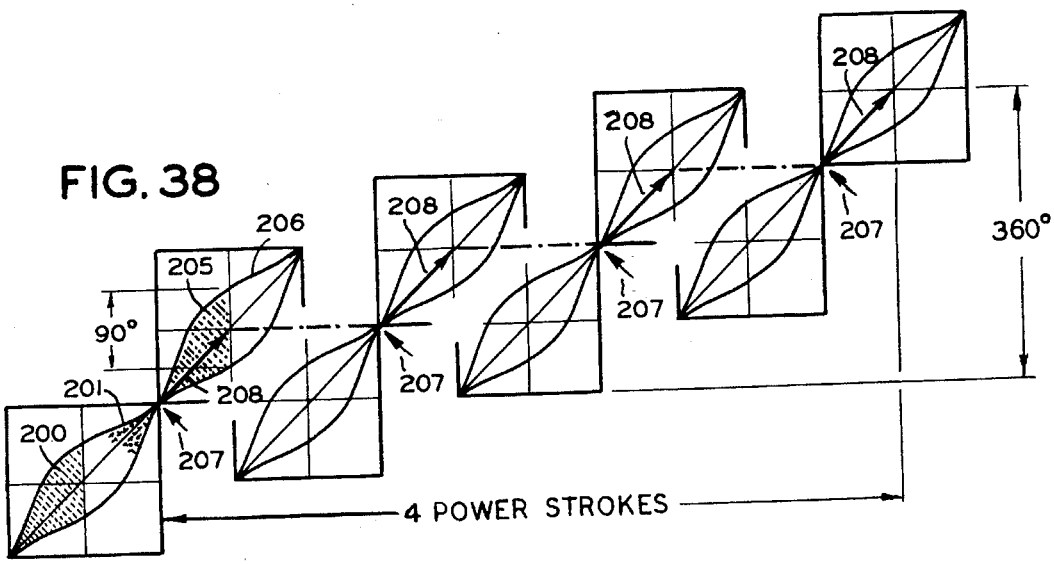

PERISTALTIC VANE DEVICE FOR ENGINES AND PUMPS

BACKGROUND OF THE INVENTION

1. Field of the Invention

This invention relates to rotary vane devices, sometimes known also as rotary piston machines, where volume changes between vanes, which are working in a cylindrical pressure chamber, are used for a direct pressure to rotary or rotary to pressure power conversion.

2. Description of the Prior Art

It has been recognized since the invention of the steam engine that a more direct energy conversion from pressure to a rotary motion without the use of a reciprocating piston can provide numerous advantages and simplifications in external and internal combustion engines, yet from the hundreds of known variable volume pressure chamber configurations, as best described, classified and tabulated in Felix Wankel's book "Rotary Piston Machines" (Iliffe Books Ltd, London 1963), only Mr. Wankel's "triangular piston" configuration has gained a wide recognition (NSU, Mazda, Curtiss-Wright etc). It was once labeled as "revolutionary significance" because of the following advantages as taken from the Encyclopedia Britannica: small space, low weight to HP ratio, smooth vibrationless operation, quiet running, comparatively low cost and simplicity, no reciprocating parts to minimize inertial and frictional losses, a better heat transfer and no poppet valves are reducing friction and make the fresh charge and exhaust more effective.

In the same book it has also been recognized that the specially classified central-axis cylindrical pressure chamber can provide the highest volumetric throughput besides its relative simplicity, but because of its concentric nature it is also believed that a smooth planetary or cranking arrangement is impossible because a second parallel axis cannot exist. Therefore the existing central-axis configurations in this class are mostly limited to the oscillating type with a stationary vane(s) and an oscillating vane(s) on the output shaft. Basically this is the construction of a rotary actuator with a special porting arrangement adapted to an internally or eternally generated fluid pressure operation, but since the reciprocating linear piston motion is just replaced then by an arcuate oscillating motion, a ratcheting or cranking mechanism still has to be incorporated with little advantage over existing piston machines or engines. One of the oscillating vane internal combustion engine with 4 spark plugs and a rotary flow directing valve is shown in U.S. Pat. No. 5,086

But instead of the oscillating vanes many unidirectional more advantageous variable motion vane devices are in existence where one set of vanes is attached to the uniform motion output shaft while the other set of vanes are on a concentric variable motion shaft. For controlling this motion hard ratchet stops (U.S. Pat. No. 1,003,80 issued to Rodigin 1911), camming arrangements (Tschudi 1927) or more complex gear mechanisms (Kauertz 1960) are used, but the shock loads in all of these arrangements are limiting their operation to slower speeds and shorter life and therefore they have not gained any wider acceptance.

A somewhat different independently centrally pivoting vane arrangement in a cylindrical pressure chamber is found in Keller's U.S. Pat. Nos. 3,748,068 and 3,797,975 where a number of vane guides between adjacent vanes are arranged on an eccentrically rotating disk whose shaft is power rotated for pumping or it will function also as an output shaft when external pressure is applied to variable volume subchambers between the vanes. This arrangement, like most rotary piston machines, has a rather difficult sealing problem and even if its complex vane shaft is mathematically calculated, as shown in U.S. Pat. No. 3,938,918 (J. Snugg and V. Ebrok), the sealing of the vanes still remains a major problem in this configuration besides its incapability for an Otto-cycle operation.

Even in the most successful and know rotary Wankel engine its "sealing grid" still requires 21 individually spring loaded sealing members working in a hard-to-machine epitrochoidal cavity while in the present invention the shape of these sealing members will be simpler and the required number of them is reduced to less than half of that in the Wankel engine.

SUMMARY OF THE INVENTION

Contrary to the belief that central-axis vane devices are limited only to the oscillating rotary actuators and engines or to the so called objectionable "cat-and-mouse" or "stop-and-go" unidirectional engines because it is impossible to create a necessary parallel axis to make a smoothly running planetary gear or cranking system work, this invention is introducing a new kinematic theory where the key element is a four-bar-type differential linkage whose control makes it possible the application of a second parallel axis which is establishing a necessary reference line on a control stator. This differential linkage can be viewed also as a special rotating four-bar-linkage without the base link which is replaced by a radial rotating control motion. It is now this radial rotating motion which permits the use of a linkup or control point for a differential mechanism controllable in few different ways where a control stator with a reference line is an important part of it. This basic novel control method, applicable to a large number of applications, is providing a positive linkup between variable motion vanes and a constant speed operating shaft with a smooth continuous motion translation without hard stops.

Similarly to a differential gearing, where the most known sample is found in the vehicular drive axle, the differential linkage has also three concentrically rotating elements with a limited angular moving freedom but because of the oscillating nature of this linkage, this limitation is not a problem. The three elements are two variable motion crank arms with connecting links whose common pivot point has a limited radial moving freedom on the third member which is a uniform motion crank arm on the power input shaft of pumps or it can be a power output shaft of engines, hereinafter called as an operating shaft. This arrangement permits a number of different ways to control the amplitude of this radial rotating control motion as well as the frequency or the number of oscillations during a shaft revolution whereby the main object of this motion control is to provide a continuously alternating accelerating-decelerating motion to the vane carrying shafts which in turn can create variable volume pressure chambers for pumping or engine operation.

The more detailed methods for controlling this rotating radial motion include a central control using a fourth concentric different speed crank arm or eccentric with a geared connection from the operating shaft. This gear connection establishes the second parallel axis for a parallel axis gear center hereinbefore believed impossible. More precisely, the second gear center on a control stator establishes the necessary reference line which permits a synchronized relationship between a control stator and a distributing stator which in turn makes possible a controlled communication between the vanes and inlet-outlet ports on the distributing stator.

The second parallel axis with a reference line appears also in a double four-bar-linkage which is limited to two oscillations per shaft revolution only but this wide angle rotation still can be geared down to any desired number of oscillations with added gearing as one of the options for some applications.

The oscillation control or the control for the rotating radial motion can be also obtained by using an orbiting crank arm geared to a stationary internal gear which becomes then the control stator with a reference line.

Further, this orbiting crank produced radial rotating motion can be also linked to one side of any known differential gear which will function then as a limited angle differential linkup means.

Finally, the radial oscillating control motion is also cam controllable using a stationary cam which will function then as a control stator with a reference line. All of these somewhat different looking control methods will produce same kind of smoothly accelerating-decelerating harmonic-motion-like vane motion whereby both variable motion crank shafts are in rotation all the time but with different speeds.

The variable motion of both crank arms can be directly coupled to two vane carriers, each with a selected number of vanes which are producing variable volume subchambers when these vanes are rotated with a variable speed and they are working in a cylindrical concentric main pressure chamber. In the above mentioned Wankel book four possible central-axis pressure chamber configurations are listed but in this invention only the stationary and rotating main pressure chamber configurations will be illustrated and discussed as possible options for coupling them to any control and power transmission configurations of this invention whereby the rectangular and round vane shapes as well as peripheral, side and internal distributor stator configurations will be more detailed options adaptable to all the main pressure chamber and control variations.

The synchronized communication of variable volume pressure chambers with inlet and outlet ports on the distributor stator is usable now to create a continuous flow of fluids in one direction. This action is very closely comparable to constrictions and dilations or peristalses appearing in the digestive system of living species for advancing food through their digestive track. Therefore the alternately accelerating and decelerating vane motion of this invention can be viewed as a peristaltic motion rotatably controlled by a peristaltic oscillating wave, whereby the number of oscillations is determining the number of vanes on each rotor from a minimum number of one each to any practical number towards infinity. This peristaltic motion, when indexed to inlet and outlet ports on a distributing stator, is creating a peristaltic flow of fluids useful for many different purposes. A mechanically created peristaltic motion in existing devices is found in peristaltic pumps where a U-shaped flexible tubing is squeezed by a rotor to force fluids through this tubing.

Thus it becomes the main object of this invention to provide a differential linkup means between three concentric independently rotating shafts whereby a pivot or control point on this linkup means is forced to follow a predetermined control path, referred to as a peristaltic wave, for the purpose of generating an alternating acceleration and deceleration to a pair of vane carriers with vanes in a cylindrical main pressure chamber for creating rotating variable volume subchambers or peristaltic steps between the adjacent vanes.

A further object is to provide a parallel axis gear connection from the operating shaft for rotating a forth different speed concentric cranking means with a link connection to the above mentioned control point whereby this gear ratio will determine the shape of the peristaltic wave.

In a modified version the object is to provide an orbiting crank with a gear ratio from an internal stationary gear for generating peristaltic waves according to a selected gear ratio.

Another object is to link the orbiting crank controlled rotating radial motion to one side of a differential gear to control the accelerating-decelerating motion of vane carriers with a limited angle differential gear instead of the differential linkage.

In another modified version the object is to make the control point function as a cam follower for a stationary cam functioning as a peristaltic wave with a reference line.

Yet in a further modified version an eccentric circle peristaltic wave with a double four-bar-linkage is used to control two oscillations per shaft revolution.

Still in another control version the object is to use the eccentric circle peristaltic wave generated oscillations as a control means together with reduction gearing to multiply the two oscillations on the control shaft to any desired number of oscillations or peristaltic steps on the pressure chamber shafts.

Another further object is to provide rotating or stationary cylindrical main pressure chamber configurations where both vane carrying variable motion shafts have a selected number of vanes matched to the peristaltic wave generated oscillations according to a mathematically determined progression.

A more detailed object is to provide the main pressure chamber configuration with stationary areas which include inlet and outlet ports whereby these stationary areas will function as internal, side or peripheral distributing stators.

Another detailed object is to provide spring loaded sealing members with overlapping and stepped corner joints for rectangularly shaped vanes.

A still further object is to link any peristaltic control mechanism to a toroidal shaped stationary or rotating main pressure chamber where one or more piston rings are used on each vane as sealing members.

Another object is to provide a concentric multi main pressure chamber configuration where each added main pressure chamber has an extra tubular shaft linked alternately to first and second control cranks which can be controlled by any of the above mentioned control methods.

A general object is to provide a structure for peristaltically moving vanes which is easy to assemble and which in addition to all the previously listed advantages of the Wankel engine has a greatly reduced number of sealing members working in a simple cylindrical main pressure chamber whose advantageous throughput or displacement volume permits a greatly improved power to weight ratio as compared to existing engines.

A further object in internal combustion engines is to provide the rotating cylindrical pressure chamber with angular air circulating cooling fins to provide a direct air cooling for the cylindrical main pressure chamber.

As a whole, all the listed objects are providing a family of differently controllable models with the flexibility of choosing their sizes, number of vanes and permitting simple modifications in the distributing stator to adapt the basic structure for pumping and compressing applications with a power rotated input shaft or using same structure with a modified distributing stator for an external pressure operation or for an Otto-cycle internal combustion engine including Diesel engines.

The controlling element for the differential linkup means in all of these variations is a peristaltic wave which is generated and used in few different ways by using a different speed central or orbiting control crank or the peristaltic wave can be an eccentric circle or a stationary cam. The necessary reference line will be drawn then through the parallel axis speed changing control gear center, through the center of the eccentric circular peristaltic wave or through any point of a stationary non-circular control wave or cam. A fixed registry of this reference line with another reference line, which is determined by the pattern of the input-output ports, will then quarantee a synchronized peristaltically moving vane and port relationship for any mode of operation.

BRIEF DESCRIPTION OF DRAWINGS

These and further features, objects and advantages will become more apparent from the following detailed description when taken in conjunction with the accompanying drawings which illustrate the most typical, somewhat different, but basically very similar control versions based on the single basic concept, wherein:

FIG. 6 is a table showing the full theoretical scope of the invention and the mathematical relationship for generating peristaltic control waves;

FIG. 7 is a crossection of a 2-vane model taken along the lines 7—7 of FIG. 8;

FIG. 8 is a crosssectional view taken along the line 8—8 of FIG. 7;

FIG. 9 is a crosssection along the line 9—9 of FIG. 7;

FIGS. 10 and 11 are showing a flywheel assembly for an orbiting crank control whereby the sectional view of FIG. 10 is taken along the line 10—10 of FIG. 11;

FIG. 13 is a section taken along the line 13—of FIG. 12 and FIG. 14 is a section taken along the line 14—14 of FIG. 12;

FIG. 17 is a section taken along the lines 17—17 of FIGS. 18 and 19, FIG. 18 is a section taken along the line 18—18 and FIG. 19 is a crosssection taken along the line 19—19 of FIG. 18;

FIG. 26 is a partial sectional view taken along the lines 26—26 of FIGS. 27 and 28 while FIG. 27 is a sectional and open cover view taken along the lines 27—27 of FIG. 26; and FIG. 28 is a partly fragmentary left end view of FIG. 26;

FIG. 31 is a geometric representation for the orbital control method applicable to a differential linkage or to a differential gear and illustrating also the central control method connectable to a one plane differential gear;

FIGS. 32 and 33 illustrate the application of the control geometry in FIG. 31 for a bewel gear type differential whereby FIG. 32 is a sectional view taken along the line 32—32 of FIG. 33 and the latter is a section taken along the line 33—33 of FIG. 32:

FIG. 34 is an enlarged detail view of three spring loaded sealing members with overlapped and stepped corner joints;

FIG. 35 is a pressure indicator diagram for an angular peristaltic motion which is schematically linked to a peristaltic subchamber;

FIG. 36 is illustrating schematically five successive Otto-cycle positions for a 4-vane peristaltic internal combustion engine;

FIG. 37 is a similar illustration for an 8-vane model but shown only in the ignition position with two spark plugs and FIG. 38 is a schematic illustration where the acceleration-deceleration chart of FIG. 5 is repeated eight times to cover a full one revolution sequence with four power strokes for a 4-vane internal combustion engine.

DESCRIPTION OF THE PREFERRED EMBODIMENTS

Before referring to a more detailed description of the various practical modifications, the basic theory and geometry for controlling the peristaltically rotating vanes will be first described.

Kinematic Theory and Basic Geometry

The full scope of the invention is based on a kinematic theory which is listed in a table of FIG. 6, later referred to only as Table, where the number of vanes N on each vane carrier is used as a bases for determining most of the other values in this Table according to the mathematical relationship as found in the last column.

In all the four geometric illustrations in FIGS. 2–4 and 31 a number of common elements are appearing which bear the same letter designations because they have same function. In all of these geometric illustrations a center point A is shown for four circles: an outer and inner cirle OC and IC determining the limits for a peristaltic wave PW and a crank circle RC determining the length of crank arms from the center point A and therefore these cranks arms $R_1$ and $R_2$ are appearing as points or crank pins $R_1$ and $R_2$ in all the illustrations. The fourth circle CC, as a control circle, can be concentric or an orbital crank circle as will be described later for FIG. 31. The proportions of these circles will be determined by crank operating angles α as found in the Table on line 3 for all the different vane numbers.

Figure 2:
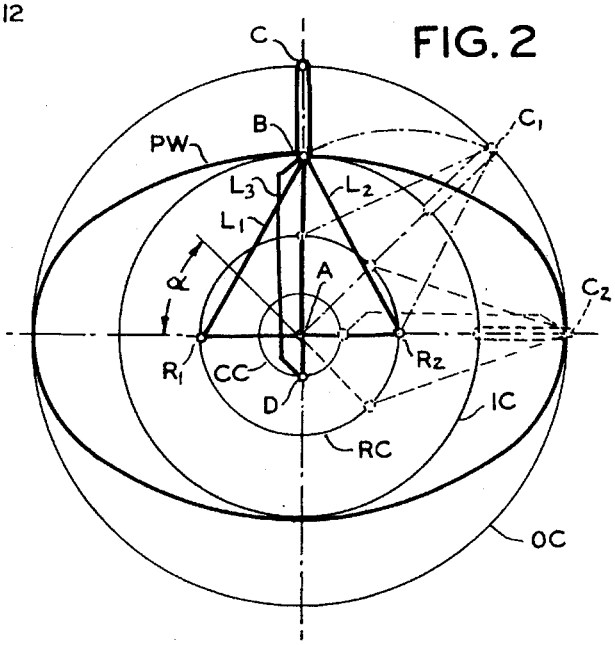
FIG. 2 is a basic geometric representation for a 4-vane model.

Referring now to FIG. 2, which is the basic geometry for a most common 4-vane model, the center point A will function also as a center for an independently rotatable crank arm ABC whereby its slotted section BC is providing a sliding fit for a control point B which is also a pivot point for two connecting links $L_1$ and $L_2$ whose other ends are pivotally linked to cranks $R_1$ and $R_2$. This five member linkage forms a limited angle differential control linkage where the vertical motion of point B to point C will cause the cranks $R_1$ and $R_2$ rotate in the opposite direction 45° each if the value of α is 45°, but if the crank arm $R_2$ will function as a stationary base link of a four-bar-linkage, then a 90° CW (clockwise) rotation of crank $R_1$ makes link $L_1$ swing to point $C_1$ and the crank ABC will rotate 45°. If now from this position crank $R_1$ acts as a base link, a 90° rotation of crank $R_2$ will swing crank ABC another 45° and point $C_1$ will swing back from circle OC to circle IC (not shown). This motion is comparable now to human walking where one foot is on the ground while the moving one moves twice the distance of the body. But if point B is forced to follow a quadratic path of an ellipse from pont B to point $C_2$, then a 90° CW rotation of crank ABC will rotate crank $R_1$ 135° and crank $R_2$ 45° in a CW direction. On the next 90° step of crank ABC the opposite will happen: crank $R_2$ will swing 135° and crank $R_1$ will advance 45°. In this manner the full elliptical path or peristaltic wave PW will cause four oscillations to point B and four alternate 45°–135° steps to cranks $R_1$ and $R_2$. This motion can be compared now to a running motion or more precisely to a smoother and faster skating motion where both skates are in motion but with an alternating variable speed. For the illustrated peristaltic wave PW the limiting outer and inner circles OC and IC could be viewed also as the major and minor circles in elliptical terminology.

In FIG. 2 a different speed central crank control method is illustrated where the crankpoint D on the control circle CC is geared to the crank ABC and a connecting link $L_3$ (shown offset for clarity) is used to link points D and B together. If now the diameter of the crankcircle CC equals the distance BC, which is also the radial distance between the circles OC and IC, and if a 1:1 reversing gear ratio is used between AD and ABC, a 90° CW rotation of crank ABC and a 90° CCW rotation of crank AD will cause the point B to follow the quadratic path of an ellipse but same control will be obtained also if crank AD is rotating unidirectionally (CW) but 270° with a 3:1 speedup ratio to reach same control point in a long way. In both of these rotating operating modes point B will be oscillated four times during a full turn of the crank arm ABC whereby the point B will follow the elliptical peristaltic control wave PW and the angularly different rotation of cranks $R_1$ and $R_2$ will have a 90° change taking place four times during the revolution of the crank ABC.

Figure 3:
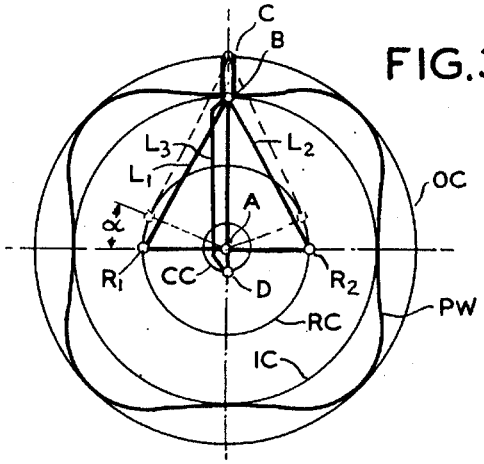
FIG. 3 is a similar geometric representation for a 8-vane model.

A similar control geometry is shown in FIG. 3 for an 8-vane model where N=4 and α=22.5°. In this version the peristaltic wave PW is built on a square (line 5 in Table) which can also be generated by the control point D on circle CC using a 3:1 reverse gear speedup ratio from crank ABC or a 5:1 unidirectional speedup ratio from crank ABC as listed on lines 6 and 7 in the Table. The smaller 22.5° nominal α value will change now the proportions of the four circles where the smaller diameter of circle CC is still the radial distance between circles OC and IC and the peristaltic wave PW has a rounded square shape producing eight oscillations along with eight alternating accelerating-decelerating variable speed rotary motions to cranks $R_1$ and $R_2$ during a uniform motion revolution of the crank arm ABC.

Thus in the central control crank versions of FIGS. 2 and 3 the common control object is to oscillate point B between circles OC and IC by means of the link $L_3$ whereby the crank AD will control the amplitude of this oscillation while the selected gear ratio will determine the frequency of this oscillation and the shape of the peristaltic wave PW. In all the cases with reverse or unidirectional gear connection the crank AD will rotate with a different speed having a gear ratio (N−1):1 for reverse operation and (N+1):1 ratio for a unidirectional operation with the same object to rotate point B in a way that it will also move to point C during any peristaltic step angle on line 4 in the Table. For any selected unidirectional or reversing gear ratios this oscillation generating motion requires the same 180° relative motion between cranks AD and ABC and therefore only the practical preferences are determining the choice for the rotating direction of point D.

Figure 1:
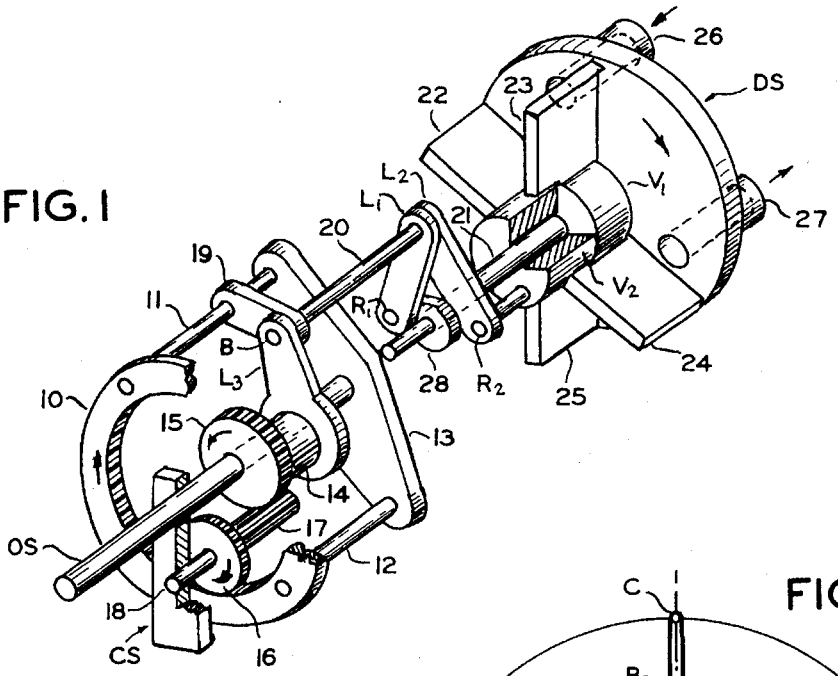
FIG. 1 is a perspective open schematic illustration of the basic concept illustrating one of the control methods requiring a parallel control axis.

The four concentric shafts (point A) together with a control gear are schematically illustrated in FIG. 1 where an operating shaft OS (ABC) is attached to an internal gear 10 by means of spacers 11 and 12 and a linkup member 13 which in practical applications can be shaped as a round flywheel. The crank AD here appears as an eccentric 14, freely rotating on shaft OS and having a 1:1 reversing ear connection from gear 10 to the eccentric drive gear 15 by means of a gear pair 16 and 17 which is running on a second parallel axis shaft 18, supported by a control stator CS which provides also a bearing support to the operating shaft OS. Basically this 1:1 reversing gear will function as a differential gear which can be also a bevel gear-type in this case. For the illustrated internal 1:1 same pitch reversing gear drive a 96:32 tooth speedup for gears 10 and 16 and a 16:48 tooth reduction for gears 17 and 15 can be used but this internal gear arrangement has flexibility for converting it to all the ratios as shown in the Table on lines 6 and 7. For instance, the unidirectional 3:1 speedup ratio for a 4-vane model (N=2) can have a 96:32 gear ratio between gears 10 and 15 with two idler gears of any size on stator CS as will be shown and described later for FIG. 13. For an 8-bane model (N=4) the 3:1 reversing gear ratio (line 6 in Table) can be also provided by a planetary gear where the internal gear 10 can have again 96 teeth in mesh with a 32 tooth planetary gear and the latter in mesh with a 32 tooth central gear.

The linear radial rotating motion BC is replaced in FIG. 1 by an arcuate motion of a lever 19 pivoting on the spacer 11 and therefore having a negligible difference. In this manner point D will be the center of the eccentric 14 with connecting link $L_3$ linking the eccentric generated oscillations to a pivot rod 20 on lever 19 which will follow the elliptical path PW of FIG. 2 whereby the pivot rod 20 will function as point B which is providing now the radial rotating oscillating motion.

The schematically illustrated open pressure chamber section in FIG. 1 has a stationary distributing stator DS providing a bearing support to a shaft 21 which is secured to a vane carrier $V_1$ with vanes 23 and 25 whereby shaft 21 will also rotatably support the other vane carrier $V_2$ with its vanes 22 and 24. The geometrically illustrated control linkage of FIG. 2 is visible now in FIG. 1 where a lever 28, which carries the crank pin $R_1$, is secured to shaft 21 for rotating the vane carrier $V_1$ while pivot point $R_2$ for link $L_2$ will be a pin directly secured to the vane carrier $V_2$.

Now a 90° rotation of the operating shaft OS will advance the vane carrier $V_1$ with its vanes 23 and 25 135° while the vane carrier $V_2$ with its vanes 22 and 24 will rotate only 45°. This variable motion will create a 90° volume increase between vanes 22 and 23 next to an inlet opening 26 and a 90° volume decrease between vanes 23 and 24 next to an outlet port 27. Same volume increases and decreases will occur on the opposite side between vane pairs 24,25 and 22,25. These peristaltic volume changes and their communication to different port patterns on the distributing stator DS will be discussed later for various models in more detail.

Figure 4:
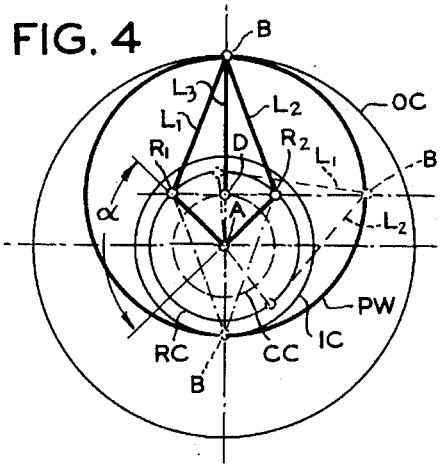
FIG. 4 is another geometric representation for a 2-vane model.

In FIG. 4 a similar but somewhat different peristaltic motion control method is described which is listed in the first column of the Table as a 2-vane model with only one vane on each vane carrier. This geometry is still built to the four concentric circles OC, IC, RC and CC and the cranks $R_1$ and $R_2$ with their connecting links $L_1$ and $L_2$ are all used similarly to FIG. 2 but the control link $L_3$, which still is pivotally secured to links $L_1$ and $L_2$ at point B, has a fixed control point D on the circle CC which means that the peristaltic control wave PW in this case is an eccentric circle about point D and the crank arm ABC of FIG. 2 will be crank DB functioning as the control link $L_3$. Also, the diameter of the imaginary control circle CC equals the radial difference of circles OC and IC.

In this case the nominal value of $\alpha$=90° is divided equally about the horizontal line through center point A and then the center D for crank $L_3$ has to be on a parallel line drawn through the crank pivot points $R_1$ and $R_2$. Therefore the eccentricity distance AD will be $$R \times \sin \frac{\alpha}{2} .$$

Through the basic differential linkage in this version is functioning again as a four-bar-linkage without the base link and the control point B is following the eccentric circular peristaltic wave PW, this linkage could be viewed also as a double four-bar-linkage with a common base link AD and a common crank $L_3$ which is functioning as the crank arm DB for the operating shaft OS. In this manner the left four-bar-linkage in FIG. 4 consists of the base link AD, cranks $R_1$ and $L_3$ and the connecting link $L_1$ while the right one consists of the base link AD, cranks $R_2$ and $L_3$ and the connecting link $L_2$. In this version the radial control motion BC of FIG. 2 disappears because point B alone is following the eccentric circular peristaltic control wave PW but the control circle CC is still determining the radial rotating control motion (the diameter of circle CC) with its two oscillations during a revolution of crank DB. A 90° midposition of this linkage in FIG. 4 is shown in dotted lines and a 180° rotation of crank DB or link $L_3$ is shown in phantom lines where crank $R_1$ has rotated 90° and crank $R_2$ 270° which really means that the position of cranks $R_1$ and $R_2$ has been reversed.

The basic features of FIGS. 2–4 are further illustrated in FIG. 31 for controlling a limited angle differential gear instead of the differential linkage sofar described. The same cranks or crank arms $R_1$ and $R_2$ have again a common center at A together with the operating crank (ABC) which in this case is a disk or flywheel 86 as will be described alter. Cranks $R_1$ and $R_2$ are shown now as gear segments with a nominal operating angle or range $\alpha$ whereby their opposing rotation can be provided with any kind of known differential reversing gear connection but in FIG. 31 a double spur gear-type one plane reversing gear is schematically illustrated which is built on an equilateral triangular gear center pattern AGH if equal size gears are used. Similar gear segments E and F are pivotally secured to disk 86 at G and H whereby they are in mesh with each other and with gear segments of cranks $R_1$ and $R_2$ which are working on a different level to clear each other. Now all of the six gear segments with three meshing points have same working range $\alpha$ which in FIG. 31 is 45°. If now any segment of this gear arrangement is linked to a control motion to produce a 45° angular motion, the cranks $R_1$ and $R_2$ will be rotated 45° in opposite direction which results to a 90° rotational difference between them comparable to the differential motion as previously described for the differential linkage.

The central crank control method of FIG. 2 is applicable here again to produce the radial rotating control motion BC. In FIG. 31 the control circle CC with crank arm AD, connecting link $L_3$ from point D to B, inner and outer circles IC and OC and the elliptical peristaltic control wave PW are shown as one control option in phantom lines where the size of control circle CC will determine the 45° working range ($\alpha$) for cranks $R_1$ and $R_2$ while the inner and outer circles IC and OC will function again as the minor and major circles for the elliptical control wave PW.

A somewhat simpler control and linkup method for the differential gear control is the orbital crank control (line 8 in Table) which is utilizing a stationary internal gear 81 in mesh with an orbiting gear 85 which has its center of rotation point 88 carried by the disk 86. It is known that if the patch circle of gear 85 is half the pitch circle of gear 81, a meshing point on the pitch line of gear 85 will draw a straight line through the center point A during a revolution of the gear 85 but any point between the center 88 and the pitch line of gear 85 will scribe an ellipse during the full revolution of center 88. In FIG. 31 a crank circle $CC_1$, same size as the crank circle CC, can oscillate a differential gear or either crank arm $R_1$ or $R_2$ also 45° when a link $L_4$ is used to connect point 84 to the crank connecting point $R_1$. Now the crank circle $CC_1$ will determine directly the inner circle $IC_1$ and the outer circle $OC_1$ and then the point 84 will follow the elliptical peristaltic wave $PW_1$ which can have a reference line K for synchronization purposes.

Thus FIG. 31 is demonstrating how the central control (phantom lines) can be connected to one plane differential gear, which could be even the one in FIG. 1 when the gear pair 16 and 17 works as the reversing gear, but the orbiting gear provides the flexibility of connecting the point 84 to the illustrated one plane differential gear or it can be linked to a side gear of a bevel gear-type differential as will be described later. FIG. 31 contains even the possibility of converting it to the eccentric circle peristaltic wave control of FIG. 4 when point D is fixed and link $L_3$ will function the same way: if it is connected to point B, a 90° peristaltic step is generated twice during a revolution, or if the size of circle CC is doubled or point B is moved half way closer to point G, two 180° peristaltic steps will be generated like in FIG. 4. These are, however, some theoretical possibilities which are more complex then the illustrated practical configurations. The orbital crank control can still be usd for larger vane numbers when the size of gear 84 is reduced or its gear ratio increased according to the line 8 in the Table.

The control geometries in FIGS. 2–4 and 31 are providing the foundation for the full kinematic theory in the Table where the vane number N on each vane carrier can increase from 1 to a theoretical infinity (line 1) and then all the other values and control gear ratios can be mathematically determined according to an orderly progression as shown in the last column in the Table.

The somewhat special case in column 1 with its geometry in FIG. 4 will be further illustrated in FIG. 7–9 and described later. This 2-vane model with one vane on each rotor has a wide angle 180° peristaltic step but its application is limited only to external pressure engines and pumping applications.

While the first column in the Table (FIG. 6) is somewhat exceptional because gearing is not applicable, all the lines for other columns will be briefly described:

LINE 1

The increasing vane number N on each vane carrier is determining all the other values.

LINE 2

This is the total number of vanes in a model.

LINE 3

The nominal value of $\alpha$ means a 3:1 angular moving relationship for the rotor cranks $R_1$ and $R_2$ .

LINE 4

The nominal peristaltic step ($2\alpha$) is based on the 3:1 relationship on line 3 ($3\alpha-\alpha=2\alpha$). The total degree value for nominal peristaltic steps during one revolution is $4N\alpha=360°$ for all cases.

LINE 5

The peristaltic wave shapes shown an orderly geometric shape progression from the eccentric circle in first column to an ellipse, triangle, square, pentagon and to further polygons.

LINE 6

This is the reverse central crank control method of FIG. 1 with a gear ratio (N–1):1 between gears 10 and 15.

LINE 7

For the unidirectional central gear control (FIG. 12) the speedup ratio is (N+1):1. For lines 6 and 7 the relative motion of cranks ABC and AD is always 180° regardless the ratio or direction.

LINE 8

For orbiting crank control the gear ratios are between the stationary internal gear and the orbiting gear.

LINE 9

Figure 26:
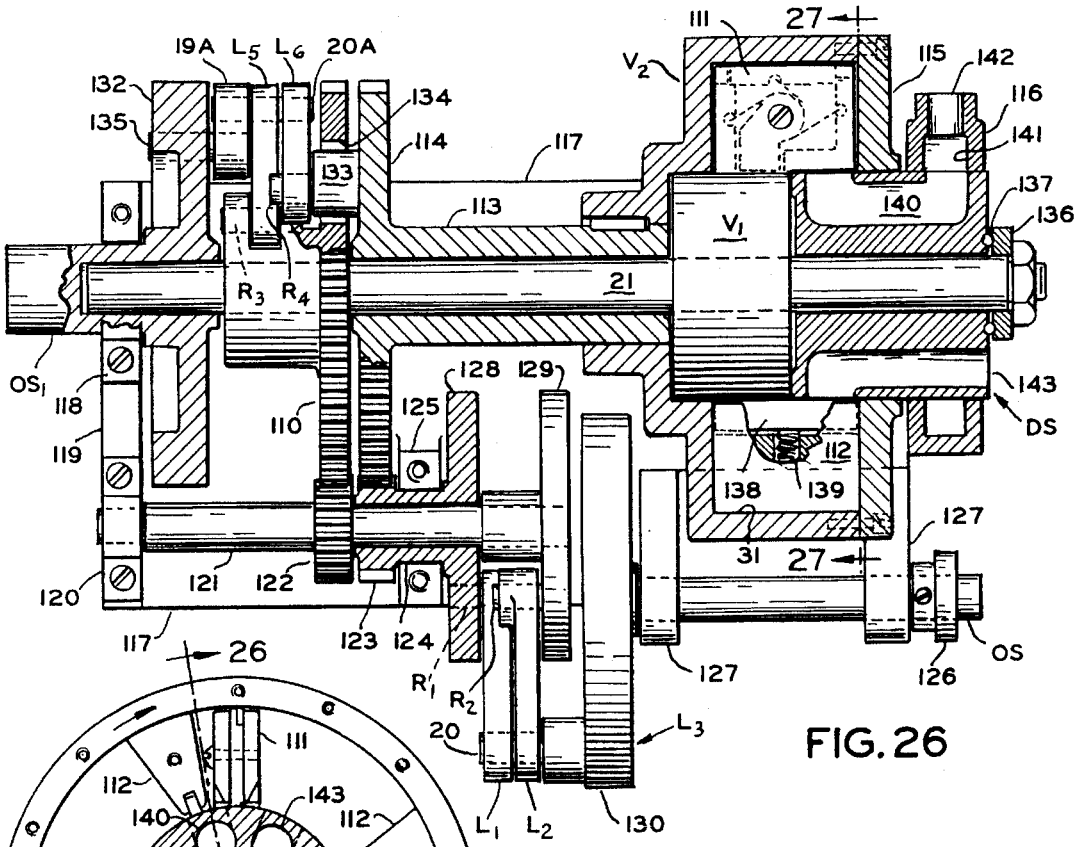
FIGS. 26–28 are illustrating an 8-vane model with a geared linkage control whereby
Figure 28:
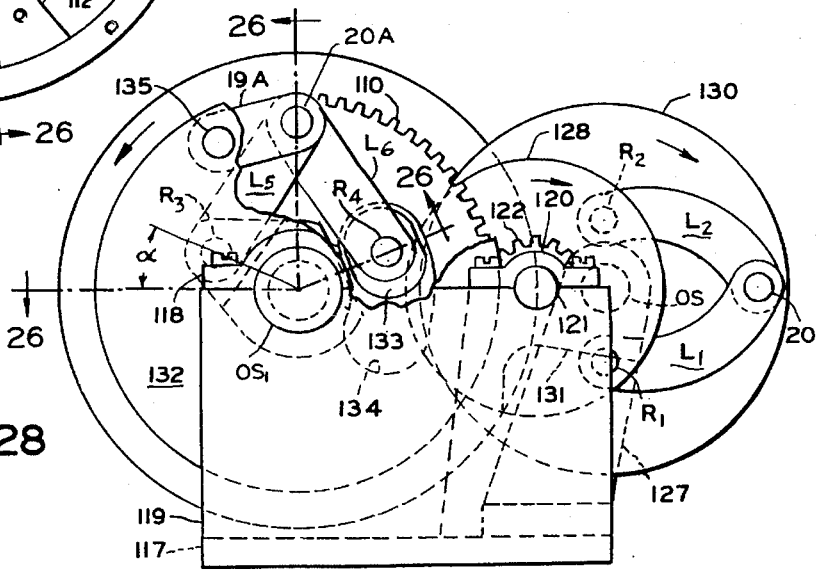

The 2-vane model control geometry in the first column (FIG. 4) is applicable for higher vane numbers with a reduction gear ratio from both control shafts as shown in FIGS. 26 and 28.

LINES 10 and 11

The factor F is a displacement volume multiplier, related again to N. It will also designate the number of inlet and outlet pots and also the spark plugs and fuel injection ports which is different for internal and external combustion engines.

Figure 12:
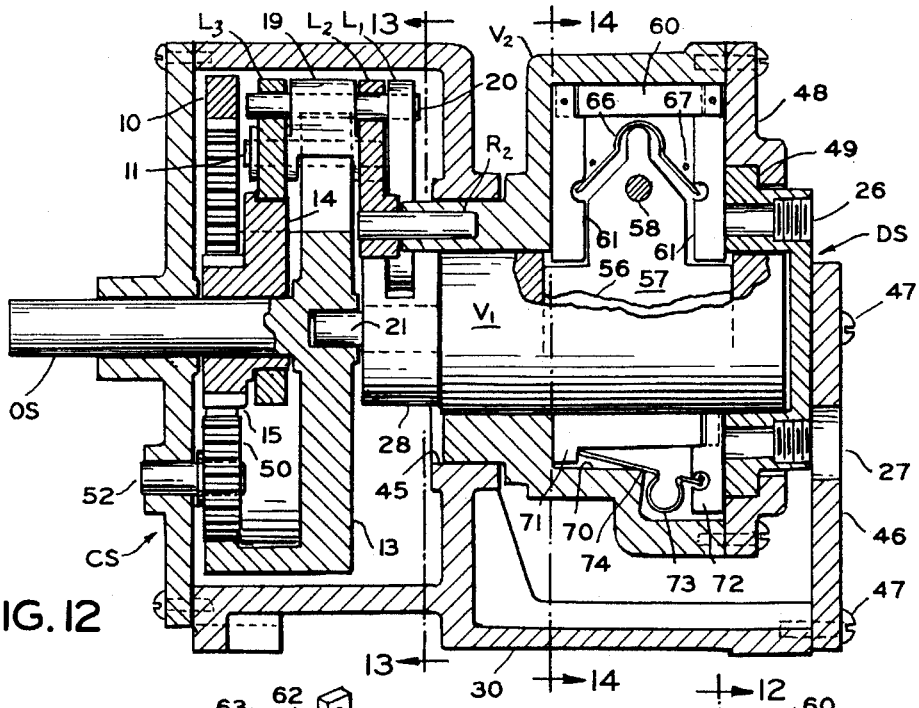
FIGS. 12–14 are illustrating a 4-vane model with a rotating pressure chamber and a central crank control whereby the crosssectional view of FIG. 12 is taken along the line 12—12 of FIGS. 13 and 14.
Figure 17:
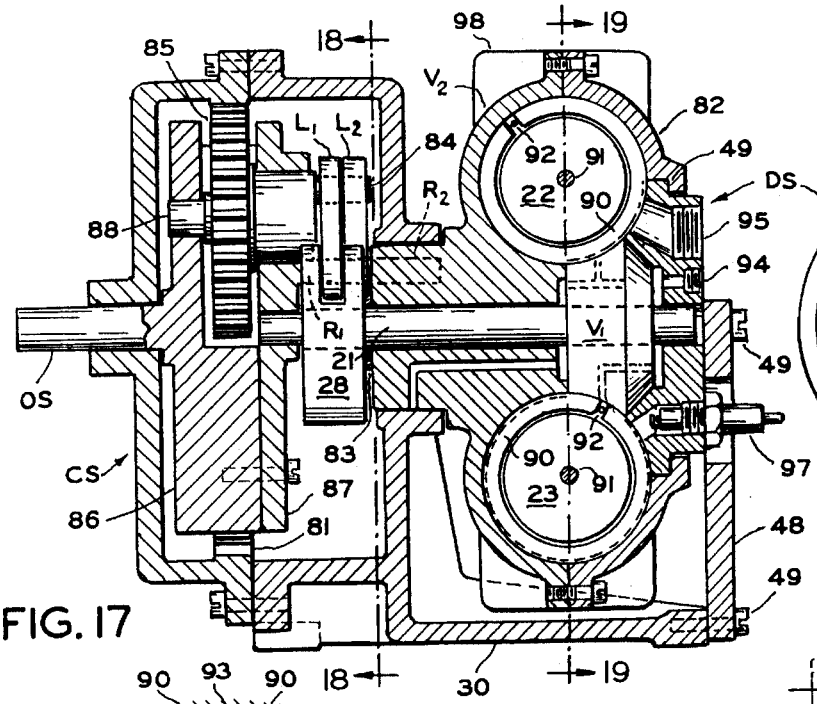
FIGS. 17–19 are illustrating a 4-vane model with a rotating toroidal pressure chamber configuration coupled to an orbiting gear control whereby
Figure 22:
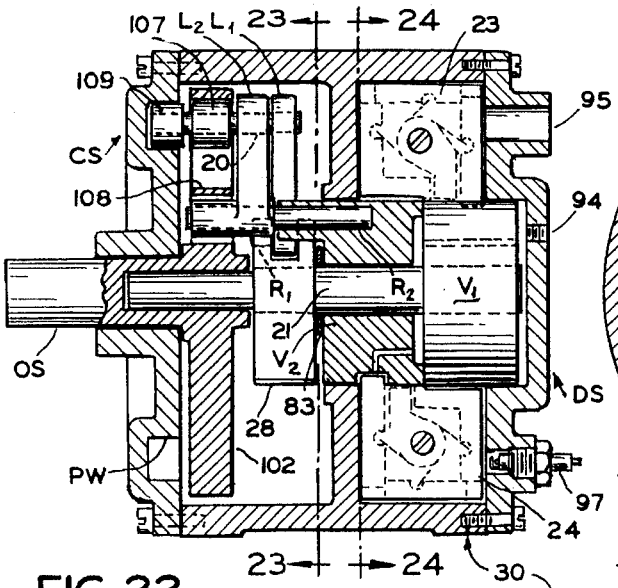
FIGS. 22–24 are illustrating a 4-vane model with a stationary main pressure chamber and a cam groove peristaltic wave control whereby the sectional view of FIG. 22 is taken along the lines 22—22 of FIGS. 23 and 24 and the sectional views of FIGS. 23 and 24 are taken along the lines 23—23 and 24—24 of FIG. 22 respectively.

The Table and the basic geometry demonstrates how same end goal or peristaltic control can be achieved in many different ways but from the large number of theoretical possibilities only the most typical and practical versions are illustrated where the most common 4-vane models in second column are also illustrated in FIGS. 17, 22 and 32 in addition to the tabulated FIGS. 1, 2 and 12.

Figure 5:
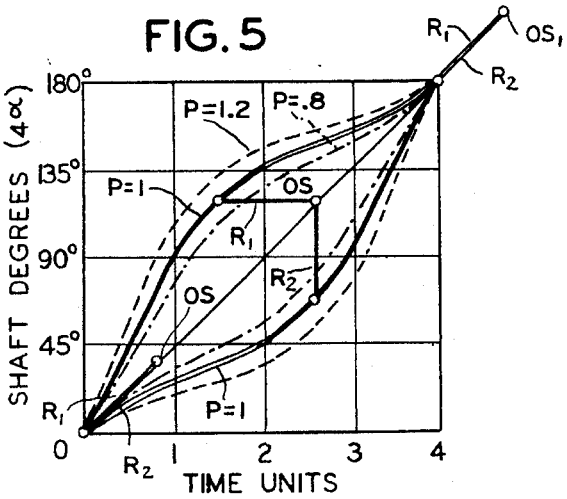
FIG. 5 is a basic acceleration-deceleration motion chart for the peristaltic motion.

A peristaltic motion curve showing a relative rotating relationship of crank ABC and the variable motion rotor cranks $R_1$ and $R_2$ is illustrated in a chart on FIG. 5 where the uniform motion of shaft OS (ABC) is shown as a diagonal line on a 180° shaft degree vs. time scale whereby the 180° figure represents the geometry in FIG. 2. Starting now from the 0 corner, crank arms $R_1$ and $R_2$ are shown schematically linked to a uniformly moving point OS on the diagonal line and on this starting position they are all in line and moving momentarily with the same speed (point B in FIG. 2 touching the circle IC) but within the 90° motion of shaft OS (ABC moving to point $C_2$) the crank arm $R_1$ will follow an accelerating curve and crank $R_2$ a decelerating curve whereby $R_1$ and $R_2$ will separate to a 90° relative position (crank $R_1$ rotating 135° and crank $R_2$ 45° as shown in dotted lines in FIG. 2) and then the speed of these three shafts will be momentarily same again. During the following 90° rotation of shaft OS the opposite will happen and in the end position on the chart ($OS_1$) $R_1$ and $R_2$ reach again the same speed with OS. In FIG. 2 this means point B will come in contact with the inner circle IC again and the speeds of all three members are same again. This momentary equal speed will occur four times during a revolution and it is very closely comparable to the dead center positions in linear motion engines where no pressure to rotary power conversion can take place.

The illustrated solid line acceleration curves and the double line deceleration curves have a symmetrically opposite shape (a 180° rotation about the centerpoint will line them up again) and they are based on the nominal value of $\alpha$=45° which provides a 90° nominal peristaltic step which is also visible on this chart (135°–45 °=90 °). These nominal value peristaltic curves are designated P=1 while the other illustrated broken line curves will be discussed later.

All the listed control methods (lines 6–9), which are producing the same peristaltic acceleration-deceleration curve as shown in FIG. 5 are related to the elliptical peristaltic wave PW in FIG. 2, but even for the other peristaltic wave shapes, including the eccentric circle in the first column of the Table, the basic shape of the peristaltic motion curve remains same, except the 180° shaft degree scale will change to $4\alpha$. This means for FIG. 4 the scale will be 360° and for FIG. 3 it is 90°.

Still, for the direct linkage connection to an orbiting crank there is a minor distortion to the curve shape while the cam control method has a flexibility to modify this curve to any desired shape.

Two Vane Models

In the selected illustrations most of the letter reference characters of the geometrical illustrations are also used in the practical illustrations for a quick common part identification along with some common reference numerals for typical same function parts. Plain bearing holes and no shaft seals are shown and it is to be understood that ordinary sleeve, ball or needle bearings as well as ordinary shaft seals and fasteners can be easily added by those skilled in the art to satisfy different requirements for different sizes and pressure conditions.

The peristaltic control of the illustrated 2-vane model in FIGS. 7–9 is based on the basic geometry in FIG. 4 (first column in Table) which is shown in applied form in FIG. 9 where the $L_1$ and $L_2$ of the double four-bar-linkage together with cranks or crank pins $R_1$ and $R_2$ are shown. In all the illustrated models a basically similar structure is used where a base member 30 is providing a central bearing hole concentric with bearing holes on each side in cover plates which are also functioning as a control stator CS on one end and a distributing stator DS on the other end. This basis structure permits an easy screw assembly from each end whereby the control components can work in an oil filled closed compartment.

The base member 30 in FIGS. 78 and 8 has a cylindrical pressure chamber section 31 with a peripheral inlet opening 32 and an outlet opening 33 functioning as the distributing stator DS but these openings or ports can be located also in a cover plate 34 which provides a bearing hole to a vane carrier $V_1$ with its shaft 21 while the same diameter vane carrier $V_2$ has a rotatable bearing mount in the central bearing hole of base 30 and also on shaft 21. While many different kind vane shapes can be attached to the vane carriers, in FIGS. 7 and 8 the vane carrier $V_1$ has a vane 35 with a sliding vane shoe 36 forced against the wall of cylinder 31 by means of a compression spring 37 and similarly the vane carrier $V_2$ has a vane 38 with a spring biased vane shoe 36.

On the control section the control stator CS is a cup-shaped cover with an eccentrically located bearing hole for an operating shaft OS. In FIG. 4 this is the point D which is determining the vertical reference line through shafts 21 and OS. If the mounting of this cover or control stator CS is made rotatably adjustable about shaft center 21 (not shown) the angular adjustment of the reference line can be used to adjust the relative position of both vanes in relation to inlet and outlet ports 32 and 33.

In FIG. 7 the shaft OS is attached to a flywheel disk 13 which is carrying the pin 20 (pont B) for a pivoting linkup with links $L_1$ and $L_2$ which are also pivotally secured to cranks $R_1$ and $R_2$ whereby $R_1$ is a pin on a disk 39 which is secured to shaft 21 but crank $R_2$ is shown to be a pin directly secured to the vane carrier $V_2$.

If now shaft OS with disk 13 is power rotated, the same speed starting rotation from the position in FIG. 8 will change to an acceleration of vane 38 and to a deceleration of vane 35 according to the peristaltic motion curve in FIG. 5 which has now a 360° shaft degree scale. This motion will uncover the inlet port 32 and the volume increase between the vanes creates a suction for any fluid. After a 180° rotation of shaft OS the vanes 35 and 38 will be in same but opposite position and the links $L_1$ and $L_2$ will be in the position shown in phantom lines in FIG. 9. During the following 180° rotation of shaft OS the 180° volume increase on the lower section in FIG. 8 will be reduced to 0 again and the fluid will be forced out through the outlet port 33.

In a different operating mode, if a fluid pressure like steam is applied through the inlet port 32 just after the vane 35 has passed its "dead center position", the opposite action will take place: the peristaltic motion of vanes 35 and 38 will be converted to a uniform rotation of operating shaft OS which will function then as the power output shaft.

For air compressor models the vanes 35 and 38 can have an almost 90° solid shape as shown in phantom lines in FIG. 8. In this case the full 180° volume as shown in the lower pressure chamber, can have a high compression ratio before the port 33 opens and exhaust starts.

This simplest 2-vane model is demonstrating the 2-way operation of the concept where the positive differential linkup between the operating shaft OS and vane carriers $V_1$ and $V_2$ permits a pumping or compressing action or the same model can function also as a motor when external pressure is converted to a uniform rotation of the output shaft OS.

Central Crank Control

Figure 14:
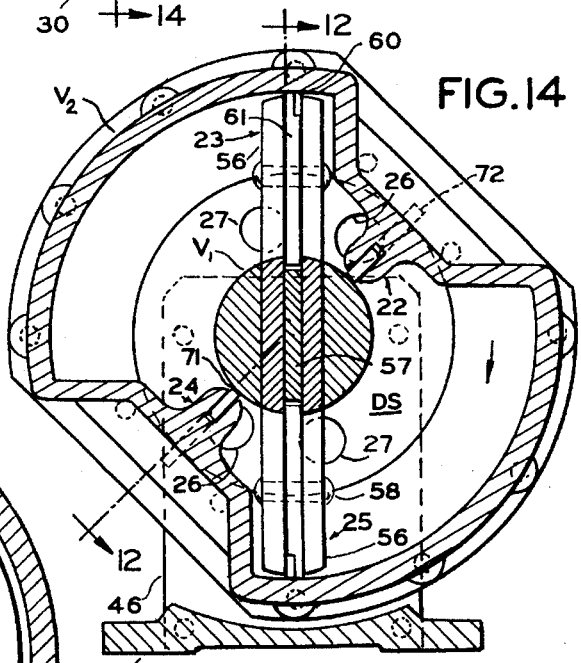
Figure 13:
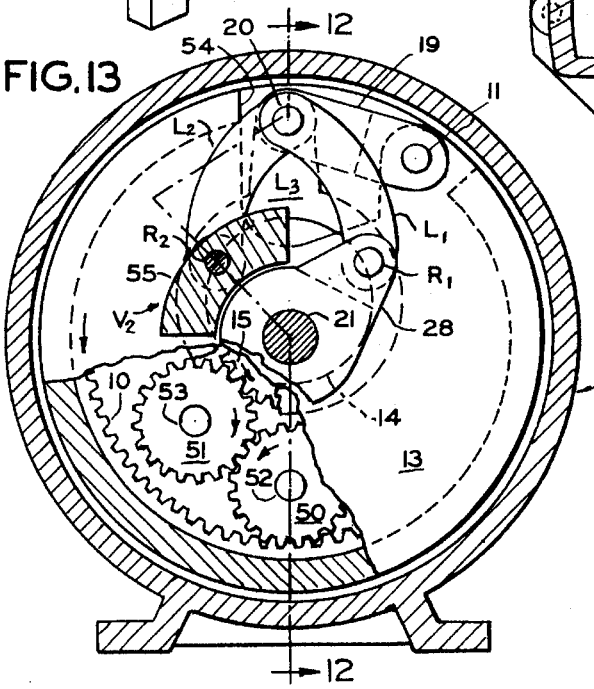

The schematically illustrated open central crank control method in FIG. 1 is shown in FIGS. 12–14 in an enclosure where a base member 30 together with the control stator CS and distributing stator DS on the other end are providing a concentric bearing support for all the four differently rotating shafts on the same central axis. The bearing hole 45 in base 30 supports the vane carrier $V_2$ together with vane carrier $V_1$ inside it while the operating shaft OS has a bearing support in the coverplate or control stator CS and the stationary distributing stator DS which is mounted to the base 30 by means of plate 46 and screws 47. This provides an internal bearing support to the vane carrier $V_1$ and an outer bearing support to a cover 48 of vane carrier $V_2$ whereby this is a stepped bearing support at 49 to resist a partial pressure inside the main pressure chamber. It is to be understood again that any kind of bearing could be applied here to suit the different pressure conditions inside the pressure chamber.

The fully covered control section, which can work in an oil bath, has same control components as shown in FIG. 1 but a unidirectional gear connection is illustrated in FIG. 13 which means that instead of the 1:1 reversing gears in FIG. 1 the 3:1 unidirectional gear drive (line 7 in Table) has a 3:1 speedup ratio between gears 10 and 15 (a 96:32 ratio, for instance) which are in mesh with two idler gears 50 and 51 of any size running on studs 52 and 53 which are mounted to the control stator CS. It is to be understood again that the control stator CS can carry one or more parallel axis for any kind of gearing for the gear ratios on lines 6 and 7 in the Table and this parallel axis will establish a necessary reference line for synchronization whereby this reference line through any connecting gear center can be adjustable if the clamping method of FIG. 32 is used instead of the illustrated direct screw mount.

The connecting member 13 in this model is shown as a flywheel and as an integral part of the internal gear 10 whereby there is a clearance opening 54 for lever 19 which has a bifurcated end for the pivot pin 11 on the flywheel 13. The other plain end of lever 19 is carrying the pin 20 (point B) which is providing a pivoting linkup to the eccentric link $L_3$ on the one side and to the links $L_1$ and $L_2$ on the other side whereby link $L_1$ is pivotally secured to the clevis-type pin $R_1$ on the lever 28 which is secured to shaft 21 and vane carrier $V_1$. The link $L_2$ again has a pivoting linkup to the crank $R_2$ which is a pin pressed to an extended section 55 of the vane carrier $V_2$ as shown in FIGS. 12 and 13. In this differential linkage unidirectionally controlled model same 180° relative rotation between operating shaft OS and eccentric 14 (crank AD) takes place as in FIG. 1 where the reverse eccentric drive was shown. The shaft extension 21 is shown entering concentrically to the shaft OS, but his concentric support is already provided by the other bearings and therefore this extra bearing joint could be also eliminated.

The control linkage, when $\alpha$=45°, is providing a 90° peristaltic motion change four times during a revolution which also means that four 90° volume changes or peristaltic steps in the pressure chamber section can be useful now for pumping or engine applications.

A rotating main pressure chamber, which is now the vane carrier $V_2$, is illustrated together with a cylindrically shaped vane carrier $V_1$ as the full inner section of the main pressure chamber, is differeng from the FIG. 1 where a split inner section is shown for a stationary pressure chamber which includes the distributing stator DS. The constructional details of the vanes 23 and 25 on the vane carrier $V_1$ and vanes 22 and 24 on the vane carrier $V_2$ can have different details to suit the variety of sealing methods as found in existing similar devices but in FIGS. 12 and 14 individually spring loaded sealing members are illustrated which are loosely working in their parallel faced seats or grooves. For the vane carrier $V_1$ a laminated design, consisting of an outer plates 56, which are slightly smaller than the inside contour of the main pressure chamber $V_2$, and a smaller spacer plate 57, which is slightly thicker than the sealing members, is illustrated. This three member lamination is inserted and secured to a rectangular slot in the vane carrier $V_1$ and then the laminations can be riveted together with rivets 58 for a strong assembly.

Figure 15:
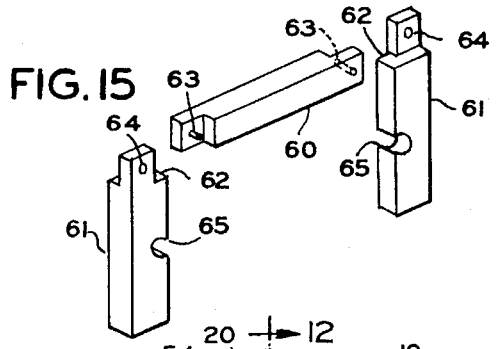
FIG. 15 is a perspective exploded detail view illustrating three overlapping and stepped corner sealing members.

A preferred three member overlapping and stepped corner seal design, which is also shown in an exploded perspective view in FIG. 15, can provide a relatively simple sealing grid which can well tolerate dimensional and thermal expansion differences and is not sensitive to wear, is shown in FIG. 12. In this design an apex seal 60 can be made comfortably shorter than the width of the pressure chamber and it has overlapping corners with two identical side seals 61 which also include a step 62 to permit a small perpendicular motion of the apex seal 60 without leakage. The apex seal 60 can have pins 63 on each end fitting freely to mating clearance holes 64 in side seals 61 to ease the assembly. Side seals 61 are provided with open slots 65 for a formed flat spring 66 whose both ends in the assembled state (FIG. 12) are resting against the corners of these slots. This angular application of spring force on both sides is forcing the side seals 61 to a full linear surface contact on both sides and in same time an upward force is created which insures first a good surface contact on steps 62 and then it will force the apex seal 60 to a good contact with the cylindrical pressure chamber wall of vane carrier $V_2$. Small pins 67 on one of the side laminations 56 are also shown in a clearance position to permit a retained preassembly to spring 66 before all the seals with their corner joint connections are snapped in and then this yielding seal assembly on vanes 23 and 25 can be fully retained for assembly conveniences.

The lower ends of side seals 61 are extending below the cylindrical surface of the vane carrier $V_1$ to a pocket which is provided by the shape of the spacer 57 and which together with outer laminations 56 is wider than the width of the pressure chamber. This little pocket also allows a sideways moving clearance and provides a radial allowance for wear or dimensional differences for side seals 61. As a result a full spring loaded self adjusting surface to surface sealing contact is provided whereby there is only one point contact on the lower ends of both side seals 61 when they are forced against the side surfaces of the pressure chamber and against one or the other side lamination 56. It is also known that in spring loaded sealing members a small side clearance in grooves allows a pressure buildup underneath the sealing members as an additional force to make these sealing joints leakproof.

Figure 16:
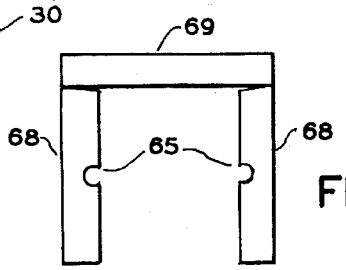
FIG. 16 is a plan view showing similar three member sealing elements without the overlapping corner joints.

In FIG. 16 a simplified butting joint substitute for the more complex corner joint version is shown where same spring force (66) can be applied to slots 65 and where the butting end of side seals 68 can have a slight clearance angle to make the outer joint tight. This design, however, requires a precision fit to the apex seal 69 similarly to the more complex apex seals as found in Wankel engines. The illustrated apex seals 60 or 69 are working against a simpler cylindrical surface in the present invention, but in the Wankel engine the more complex epitrochoidal pressure chamber cavity requires an angular seal-to-surface moving freedom which means there is only a line contact instead of a surface contact and moreover, the extra parts for corner joints between the apex seals and side seals in Wankel engines requires a very high precision and careful assembly and therefore this is considered to be one of the ramaining unavoidable serious problems in Wankel engines.

The rotating vane carrier $V_2$ could have a fully cylindrical shape main pressure chamber cavity with separate vane blocks including slots or grooves 70 for sealing members but in FIG. 14 a thin wall design is shown which provides two opposing 90° mating surfaces to vanes 23 and 25 of the vane carrier $V_1$. This main pressure chamber is illustrated as a one piece structure with the cover 48 but it is to be understood that it can be assembled from different separate parts to suit any manufacturing preference. The sealing requirement on these vanes 22 and 24 is only against the vane carrier $V_1$ and also against the stationary distributing stator DS and therefore a precision fit L-shaped single spring loaded sealing member can be used but in FIG. 12 two sealing members 71 and 72 with a single overlapping corner joint, just described, is used which can be also self adjusting as described before. Here a multi direction spring force is applied again by a single formed flat spring 73 whose looped section makes it function as a compression spring to force the left end of the seal 71 to the left and the seal 72 to the right against the surface of the distributing stator DS. In same time the spring 73 is resting against a fulcrum point 74 whereby its normally not linear shape can create an upward force on its both ends to force the seals 71 and 72 against the vane carrier $V_1$.

The distributing stator DS in FIGS. 12 and 14 has two inlet ports 26 and two outlet ports 27 which means this 4-vane model is adapted to external pressure or pumping applications where a double action can take place. In FIG. 14 this means also that an external pressure such as steam, air or water is led into the closed subchambers between vane pairs 22, 23 and 24, 25 through both inlet ports 2 and then the peristaltic motion can start to rotate the vane carrier $V_2$ 135° and the vane carrier $V_1$ 45° which is resulting to the first 90° rotation to the shaft OS. After this, three more alternating vane motions or three more peristaltic steps will follow to complete a full 360° uniform rotation to the power output shaft OS.

For pumping action the shaft OS will be power rotated as explained before but for the internal combustion operation the distributing stator DS for this 4-vane model will be provided with only one inlet and one exhaust port and also with a spark plug or with an injection point for Diesel operation. In this case the engine will be single acting (line 10, column 2 in the Table) as will be described next for FIGS. 17–19.

Orbiting Crank Control

Figure 19:
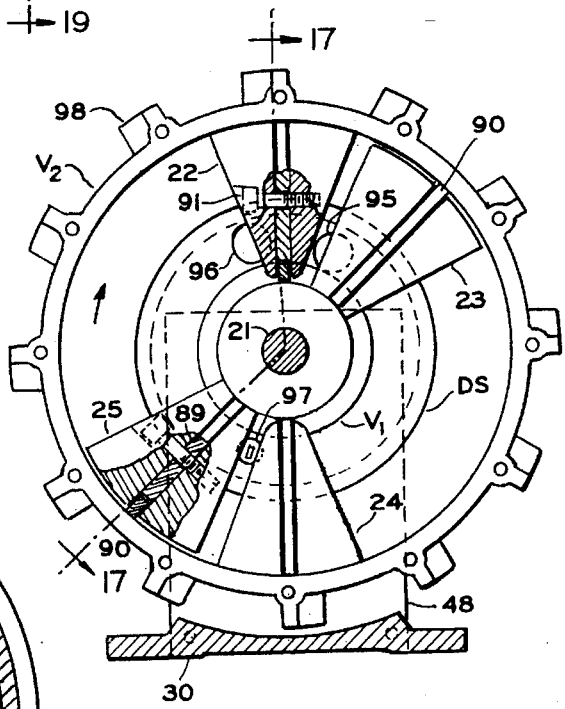
Figure 18:
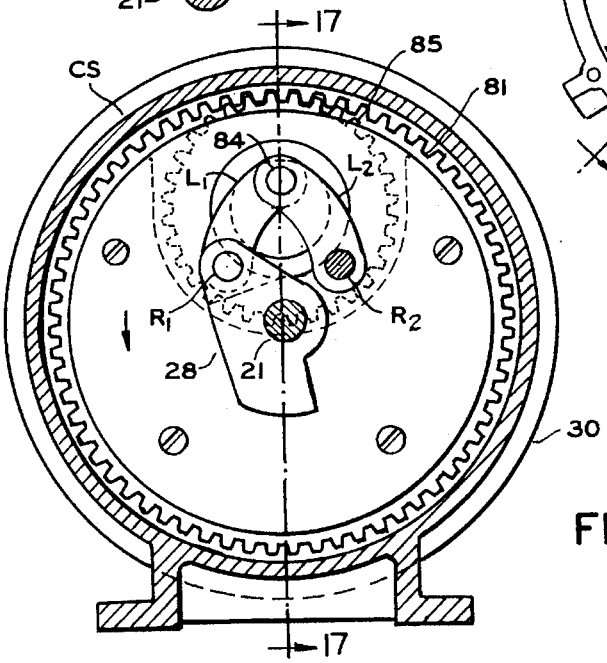

A similar rotating pressure chamber 4-vane model structure is illustrated in FIGS. 17–19 but in the control section an orbiting crank control with the stationary internal gear 81 and an orbiting gear 85, as geometrically illustrated in FIG. 31, is shown in an applied form while in the pressure chamber section the basic construction is same as in FIG. 12 but a round vane shape is illustrated for an internal combustion engine just as another option controllable by any of the peristaltic control methods in the present invention. Since most of the components, which carry same reference characters were previously described, they are only briefly discussed.

The base member 30 together with control stator CS and distributing stator DS, which is secured to base 30 by the plate 48 and screws 49, is providing again a concentric bearing support to vane carriers $V_1$ and $V_2$ and to the operating shaft OS but instead of the central crank control (circle CC for point D) the orbiting crank circle $CC_1$ is used where the crankpin 84 is carried by the orbiting gear 85 as was geometrically described for FIG. 31 and which is now illustrated in applied form in FIGS. 17 and 18. The peristaltic control wave PW, in this case is still an elliptical shape and in the Table this refers now to the line 8 in the second column.

In FIGS. 17 and 18 the control stator CS includes the stationary internal gear teeth 81 and it provides a bearing support to the output shaft OS which is carrying a heavy flywheel 86 (shown in FIG. 31 as a disk) together with a coverplate 87 secured to it. This is providing a good bearing support to the orbiting gear 85 whose tooth number is half of the teeth in gear 81 for the 4-vane models. The right shaft end of the gear 85 has a larger diameter for accepting a crankpin 84 (on circle $CC_1$ in FIG. 3). Now the previously discussed differential control linkage can be directly linked to the crank pin 84 which in basic sense will function same way as the pin 20 in FIG. 1 or the point B in FIG. 2 for providing the radial rotating control motion BC. Again links $L_1$ and $L_2$ are providing a pivoting connection to cranks $R_1$ and $R_2$ very similarly as previously described whereby the circle of the crankpin 84 will determine the shape of the elliptical peristaltic wave as shown in FIG. 18.

In the toroidal main pressure chamber of FIG. 17 three quarters of this pressure chamber is provided by the vane carrier $V_2$ and by its cover 82 while the last quater is divided between the vane carrier $V_1$ and the stationary distributing stator DS which has a stepped bearing fit at 49 similarly to FIG. 12. The vane carrier $V_1$ is secured to the shaft 21 again which has a bearing fit in the distributing stator DS, inside the vane carrier $V_2$ and in shaft OS while on its left end lever 28 is secured to it for a clevis-type crank $R_1$ pivot. A thrust washer 83 or any other thrust bearing is insuring a close running fit between the central mating surfaces of vane carrier $V_1$ and $V_2$. The illustrated toroidal main pressure chamber configuration is more difficult to machine but with a carefully planned tooling and machining steps it is possible to insure a satisfactory circular shape for accepting the ordinary piston rings as the simplest sealing method.

Figure 21:
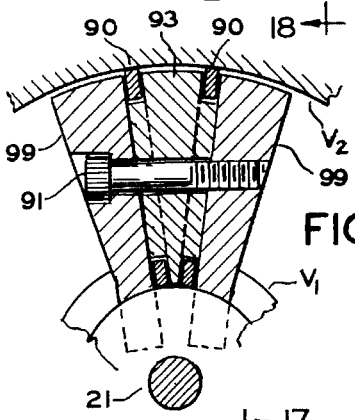
FIG. 21 is an enlarged vane design for two round sealing elements or piston rings.

In FIGS. 17 and 19 a laminated vane structure, including a spacer disk 89 which is again slightly thicker than the piston rings 90, is used on vanes 23 and 25 which are secured to the vane carrier $V_1$ and a similar laminated structure is used on vanes 22 and 24 as part of the vane carrier $V_2$. A clearance on outer laminations is provided again against the mating moving surfaces and screws 91 are used to tighten these laminations together to a strong vane assembly. The splits in the piston rings 90 are received by the locating pins 92 opposite to the working sections of the rings to insure their proper working contact which is 270° for the rings on vane carrier $V_1$ and only 90° for the rings on the vane carrier $V_2$. More than one piston ring can be fitted to all the vanes for a still better sealing as shown in an enlarged detail view of FIG. 21 where two radially oriented grooves are provided by a wedge-shaped spacer 93 which is inserted into a mating space between the outer vane laminations 99 and tightened by the screw 91.

Figure 20:
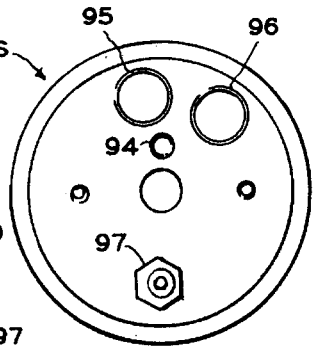
FIG. 20 is a detailed end view of a distributing stator for an internal combustion engine.

An oil entrance hole 94 on distributing station DS is shown from where the pressurized lubricating oil can pass to all the critical areas by oil passage holes as partly shown in dotted lines. In FIG. 20 a detail of the distributing station DS is showing a communicating hole pattern for an internal combustion engine including an intake port 95, an exhaust port 96 and also a spark plug 97 which in Diesel engines will be a fuel injection port. A full Otto-cycle operation will be described later.

For cooling, the rotating main pressure chamber $V_2$ can be provided with angular fins 98 to provide a good air flow and a very direct cooling and if a suitable shroud is used around the fins, a controlled amount of the heated air can be conveniently used for heating passenger compartments in vehicular applications which can eliminate a considerable amount of water cooling and heater components in conventional vehicles.

The illustrated basic control method and structure is suitable for linking it to any rotating or stationary pressure chamber configuration whereby the different vane numbers N are referring to different possible control ratios on line 8 in the Table which really means that the stationary internal gear 81 and its structure can stay same and only the size of the gear 85 and the control circle $CC_1$ (FIG. 31) will be reduced for higher vane numbers. In FIGS. 10 and 11 a similar flywheel assembly is illustrated as a substitute for FIG. 17 but the orbiting gear 100, which is again rotatably supported by the flywheel 86 and its cover plate 87, has a 3:1 ratio for a 6-vane model as listed in the third column in the Table. Also, instead of a direct connection to links $L_1$ and $L_2$ a lever 101, whose bifurcated end is pivoting on a pin 11 of the flywheel 86, is carrying the pin 20 on its other end which can function again as point B in FIG. 2 for links $L_1$ and $L_2$.

The point 84 on the crank circle $CC_1$ (FIG. 31) in this version is the center of an eccentric 103, secured to the gear 100 and working between bearing plates 86 and 87 whereby a spacer block 104 is used for additional mounting strength. Now the same function connecting link $L_3$ is used to transmit the eccentric generated oscillations to the lever 101 or to the pivot point 105 which can introduce also a lever ratio between points 105 and 20 as another design flexibility. Despite the additional two parts in this version the pin 20 is radially further out than the crank pin 84 in FIG. 18 which allows the proportions of the differential linkage to be increased and which also avoids the small distortion to the peristaltic motion curve in FIG. 5 as was mentioned before.

The peristaltic control wave for FIG. 11 will be now a rounded triangle and then the uneven vane number N prevents the application of this version to the internal combustion engines. But if N=4 the orbiting gear 100 has to have a 4:1 ratio to the stationary internal gear 81 and then the peristaltic wave will be a rounded square and the proportions of the differential control linkage will then be based on the nominal value of $\alpha$=22.5° which is providing 8 peristaltic steps during a revolution. This 8-vane model is now applicable as a double acting internal combustion engine where the pressure in opposite subchambers also eliminates the bearing loads. It can be further applied to an 8-vane external pressure engine or to a pump which will be then quadruple acting.

Cam Control

All the peristaltic wave shapes on line 5, which can be generated by the gearing methods on lines 6–9 in the Table, can be also can contours on the control stator CS and then the object is to make point B (FIGS. 2 and 3) to follow this cam contour for providing a cam controlled radial rotating control motion BC with the link $L_3$.

Figure 23:
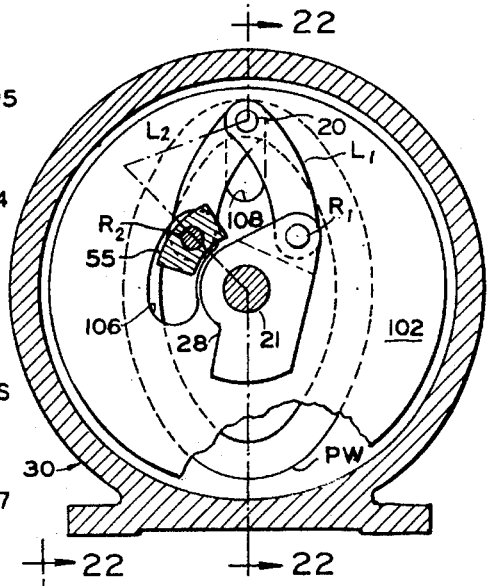
Figure 24:
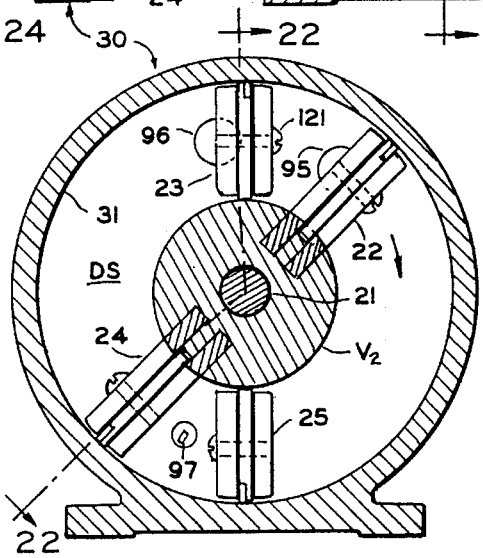

In applied form this method could provide the simplest configuration with only five moving parts. In FIGS. 22–24 a 4-vane stationary main pressure chamber internal combustion engine is shown where the base 30 includes the cylindrical main pressure chamber 31 and the concentric bearing support for the vane carriers $V_1$, $V_2$ and for the output shaft OS is provided by the central bearing hole in base 30 and bearing holes in control and distributiong stators CS and DS on both ends very similarly to the previously described version. The remaining two moving parts will be then the links $L_1$ and $L_2$ which are linking the pin 20 (point B) to cranks $R_1$ and $R_2$ whereby $R_1$ is again a clevis pin on the lever 28 which is secured to shaft 21 and the latter to the vane carrier $V_1$ while the thrust washer 83 is helping to keep both vane carriers centrally together.

Figure 25:
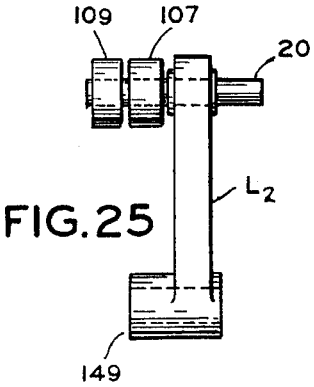
FIG. 25 is an enlarged detail view of a connecting link for FIG. 22.

The crank pin $R_2$ is secured to the extension 55 of the vane carrier $V_2$ and this provides a stable pivoting support to link $L_2$ whose enlarged detail in FIG. 25 includes a longer bearing bushing 149 which is working in a 45° clearance hole 106 in a flywheel disk 102 of shaft OS. The disk 102 has a radial slotted hole 108 functioning as the sliding fit BC for point B in FIG. 2 and now the control point B is the pin 20 carrying cam follower rollers or bearings 107 and 109 for slot 108 and for an elliptically shaped cam groove or peristaltic wave PW in the control stator CS. The illustrated four part differential control linkage for the elliptical cam groove PW is adaptable to any peristaltic wave shape on line 5 in the Table including the eccentric circle but the linkage in FIG. 4 will be a simpler method for the 2-vane models.

Any stationary or rotating pressure chamber configuration so far described is controllable by this cam control method but in FIGS. 22 and 24 a stationary main pressure chamber 31 is illustrated where the vane carriers $V_1$ and $V_2$ have same constructional details as in FIG. 7 but there are now two vanes 23 and 25 on vane carrier $V_1$ and two vanes 22 and 24 on the vane carrier $V_2$ like in the schematic illustration of FIG. 1. All of these vanes can have different detail designs but in FIG. 24 a somewhat similar laminated design as previously described with individually spring loaded sealing members on each vane is shown whereby their details will be described later. For a stationary pressure chamber, side or peripheral communication hole patterns can be used for in FIGS. 22 and 24 the side distributing stator DS is provided with an inlet port 95, an exhaust port 96, a spark plug 97 and a lubricating hole 94 similarly to the hole pattern in FIG. 20.

This model is again convertible to an external pressure or pumping version if the communicating hole pattern is changed to a double acting version with two inlet and two outlet ports as shown in FIG. 14. It is also understandable that the relationship of the reference lines on control and distributing stators CS and DS can be easily made adjustable about the central axis whereby the reference line on the peristaltic wave could be the long axis of the ellipse or it could be a line drawn through a corner or flat on any geometric shape on line 5 in the Table while on the distributing stator DS it is the communicating hole pattern which is determining this reference line.

Offset Crank Control

The simplest peristaltic control method in FIG. 4, where the eccentrically offset operating shaft OS functions as the second parallel control axis, is directly applicable to the wide angle 2-vane models only (FIGS. 7–9), but with a speedup gear ratio between both control shafts (line 9 in the Table), this control method is applicable to any vane number or more precisely the 180° peristaltic steps can be geared down to get any peristaltic step angle on line 4 in the Table for higher vane numbers.

Figure 27:
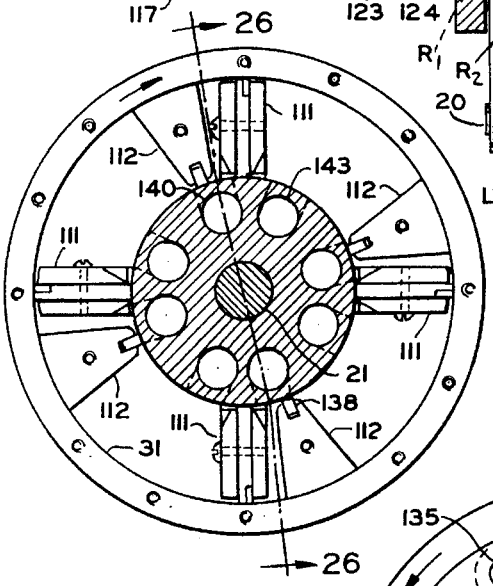

For larger open models in FIGS. 26–28 three parallel shafts are used where in the pressure chamber section shaft 21 has the vane carrier $V_1$ with four vanes 111 and a control gear 110 secured to it while the concentric vane carrier $V_2$ is a rotating main pressure chamber with a cylindrical internal shape 31 and also with four vanes 111 all keyed to a hollow shaft 113 of the second control gear 114. Shaft 21 has a bearing inside an internal distributing station DS which has same diameter as the vane carrier $V_1$ and which provides on its outside a bearing fit to a cover 115 for the main pressure chamber $V_2$.

The distributing station DS is surrounded by a flow dividing internal groove ring 116 which is also shaped as a supporting bracket for mounting the entire right bearing end to a base plate 117. On the left end the shaft 21 has a bearing fit in a partly hollow shaft $OS_1$ which has a split bearing support 118 on a pillow block or end plate 119 and which further provides a split bearing mount 120 to a control shaft 121 with a reduction gear 122 whereby a second reduction gear 123 is a part of a hollow shaft 124, rotatable on shaft 121 and supported by another split bearing mount 125 (shown open) which is also supported by the base plate 117. The third parallel shaft OS has a bearing fit with a retaining collar 126 in a bracket 127 which is again screwed to the base plate 117. These three shafts are shown on the same horizontal line but it is obvious that any shaft center arrangement can be used here to satisfy various design requirements.

Secured to shafts 121, 124 and OS are flywheel disks 128, 129 and 130 which are mounting pivot points or crank arms $R_1$, $R_2$ and the pin 20 for the links $L_1$ and $L_2$ same way as shown in FIGS. 4, 7 and 9. The curved shape of links $L_1$ and $L_2$ and a notch 131 in disk 129 are providing a rotational clearance for the linkage.

A second differential linkage between gears 110 and 114 and a flywheel disk 132 on shaft $OS_1$ is illustrated as an optional concentric power transmission linkage where crank $R_3$ is a clevis pin on gear 110 for a link $L_5$ and crank $R_4$ is a pin on an extension 133 of gear 114 working in a 45° clearance hole 134 in the gear 110. Both links $L_5$ and $L_6$ are pivotally secured to a pin 20A which is secured to a link 19A which again is pivoting on a stud 135 of wheel 132.

In this double differential linkage arrangement the 180° peristaltic steps are produced by the eccentric circle peristaltic wave to shafts 121 and 124 and after a 4:1 reduction gearing on both shafts by means of gear pairs 122, 110 and 123, 114 the shafts 21 and 113 with have eight 45° peristaltic steps which are producing a rounded square peristaltic wave (similar to FIG. 3) to point 20A and a uniform rotary motion to pin 135 and shaft $OS_1$. Since the peristaltic control is already provided by the eccentric circular peristaltic wave (2 oscillations), the eight oscillations on pin 20A do not require a second control gear.

The illustrated rotating main pressure chamber in this version has very similar details to the ones previously described but the internal distributing stator DS is shown as another design option which permits the use of a full cover 115 which means the three sides of the rotating main pressure chamber or vane carrier $V_2$ are rotating together and the central cylindrical section is divided by the stationary cylindrical distributing stator DS and by the vane carrier $V_1$ which are held together by a nut adjustable thrust plate 136 where thrust bearing balls 137 can be used if desired.

The sealing for the four vanes 112 on vane carrier $V_2$ can be done by a simple sealing strip 138 which is forced against the vane carrier $V_1$ and distributing stator DS by means of a spring 139 (compression or flat). For the four vanes 111 on the vane carrier $V_1$ a similar sealing method with three spring loaded overlapping and stepped corner sealing members can be used and will be described later.

This 8-vane model is illustrated as an external pressure (steam etc) model with four inlet ports 140 which have a U-shaped passage to an internal annular groove 141 in ring 116 which has a single inlet opening 142 anywhere on its periphery. There are also four outlet openings 143 which can be L-shaped holes discharging directly to the atmosphere. In FIG. 27, where the vane position is past its "dead center position", any external fluid pressure from the inlet port 142 will be directed to the four subchambers between the adjacent vanes in the illustrated "slightly past the closest position" and then the accelerating-decelerating motion differential starts a clockwise rotation to both vane carriers which are now controlled by the eccentric peristaltic wave. There will be four simultaneous 45° peristaltic steps if $\alpha$ is 22.5° occuring eight times during a shaft revolution and both uniform motion output shafts OS and $OS_1$ with a four times speed difference can be used now but if only the high speed shaft OS is used, the complete differential linkage ($R_3$,$R_4$ and $L_5$, $L_6$) and shaft $OS_1$ can be eliminated but then both 4:1 gear pairs will be power transmission gears requiring more strength. On the other hand both of these gear pairs will function only as lighter construction control gears if shaft $OS_1$ is used as the power output shaft. This provides another design flexibility which may have importance in marine propeller drives where a direct slower speed propeller rotation can be provided by a steam or internal combustion engine with a larger pressure chamber diameter where the vane number N together with the ratio on line 9 in the Table can be further increased.

If this model is converted to an internal combustion engine, it will be a double acting one and then the distributing stator DS will have 2 inlet and 2 exhaust ports with 2 spark plugs which have to provide 8 spark ignitions during a revolution. While spark timing and contact making can be picked up from different rotating members, the collar 126 with 2 contact making points is a convenient place in this model whereby even for larger vane numbers the 180° contact making from collar 126 still stays same because the change will be in the gear ratio only which is multiplying the 2 contact points accordingly.

The control stator reference line in this model is determined by or drawn through the shaft centers 121 and OS and now if shaft center OS can adjustably swing about the center 121, a synchronization adjustment between the peristaltic steps and a communicating hole pattern on the distributing stator is possible, but this adjustment can be also done by adjusting the relationship of gears 122 and 123 and disks 128 and 129. Again, any other previously described pressure chamber configuration or operating mode is applicable for this offset control crank version.

Orbiting Crank with Differential gear

The geometric illustration in FIG. 31, where a central crank control from the circle CC was discussed as one option to provide a peristaltic oscillation to a one-plane differential gear and then same size orbiting crank circle $CC_1$ was shown as another option to control the same differential gear, provides a basic geometry where the orbiting gear 85 with the stationary internal gear 81 was illustrated in FIGS. 17 and 18. The same flywheel 86 and orbiting gear drive appears also in FIG. 32 where the crank pin 84 with link $L_4$ is used to provide a connection between the elliptical peristaltic wave controlled radial rotation motion (BC) and a bevel gear-type differential gear which in basic sense works same way as the one-plane differential gear because one side of the differential gear is linked to the orbiting crank 84 and the reversing gear is running on the uniform motion disk or flywheel 86.

The differential gear-type peristaltic motion control is again connectable to any rotating or stationary pressure chamber version but in FIGS. 32 and 33 a 4-vane stationary pressure chamber model is illustrated which can have a side or peripheral distributing stator communicating hole pattern suited to any operating mode previously described.

The bearing support for the operating shaft OS and vane carriers $V_1$ and $V_2$ with its shaft 21 is provided again by a central hole in base 30 and bearing holes in control and distributing stators CS and DS whereby the central bearing support is stepped to also accept a pinion bushing 150 which is secured to the flywheel bearing disk 87 by means of screws 151 while the disk 87 is secured to the flywheel 86 by means of screws 152 which can be reached also from the left side for assembly convenience before the control stator CS is adjustably assembled by a clamping ring 153 and screws 154. This clamping method could be used on any previously described model to provide a convenient synchronization adjustment.

In the stationary pressure chamber section the centrally split vane carriers $V_1$ and $V_2$ with vanes 23, 25 and 22, 24 are illustrated similarly to FIGS. 1 and 22 where the cylindrical (31) main pressure chamber is covered with the distributing stator DS with two inlet openings or ports 26 and two outlet ports 27 which can be now located also on the periphery of the main pressure chamber 31.

In FIG. 32 the three elements of the most common bevel-gear-type differential are linked to vane carriers $V_1$ and $V_2$ and to the operating shaft OS where the vane carrier $V_2$ is directly functioning as one of the side gears of a differential with opposing teeth 155 while the vane carrier $V_1$ is keyed to the shaft 21 which has a rotatable bearing fit through the vane carrier $V_2$ and a spacer collar 156 and a keyed fit to a second side gear 157 whereby the end of shaft 21 can have another bearing fit in the disk 87. The two reversing pinions 158 have a bearing fit on pins 159 which are secured to the bushing 150 and also to the spacer ring 156 which has next to it a retainer ring 160 and a thrust washer 161 to keep the vane carriers $V_1$ and $V_2$ next to each other whereby this fit can be adjustable by an adjusting nut 165 which has a locking washer 163 with retainer tabs. Both side gears have only a 45° working range with the reversing pinions 158 to provide a 90° peristaltic step which is same as geometrically shown in FIG. 31. In FIG. 33 for two pinions 158 only few mating teeth are required on side gears 155 and 157 but if more pinions 158 are used, full tooth side gears are more practical because they also eliminate the need for a marked gear assembly.

Now the only connecting link $L_4$ in this version, which requires a clearance 164 in the bushing 150, is linking the orbiting crank pin 84 to a pin on the side gear 157 which is functioning as crank point $R_1$ in FIGS. 31–33 and then the crank circle $CC_1$ is controlling a reversing oscillating range of $\alpha$=45° to both side gears which amounts to a 90° acceleration-deceleration difference as a peristaltic step. Thus the reversing pinions 158 will function same way as the one plane reversing gear sectors E and F in FIG. 31 whereby in both cases this reversing gear is secured to the disk or flywheel 86.

While all the components in this version can have almost a natural balance about the central axis, the crank pin 84 and link $L_4$ have a radially oscillating center of gravity but a part of this radially changing weight or center of gravity can be balanced by a heavier section 165 on the side gear 157, by a balanced flywheel 86 and by a counterbalanced design of gear 85 which can include a lightened section 166 next to the crankpin 84. With a carefully selected compromise between these three rotating and moving members a compete rotational balance can be obtained.

The split vane carrier design in FIG. 32 and also in FIGS. 22 and 26 can have a similar overlapping and stepped corner sealing member design between laminated vanes as described for FIG. 15 but with a slightly different spring loading. In FIG. 34 the left seal 61 is same as in FIG. 15 with a slot 65 for a flat spring 167 which has its other end anchored to a slot of a spacer plate 168 and which has next to it a thin sheetmetal formed retainer 169 with slightly curved bentover sections 170 which are clearing the springs 167 in their operating position. In this manner all three springs 167 are applying an angular spring force to the notches 65 in the left seal 61, in an apex seal 171 and in a L-shaped right seal 172. Thus all the springs 167 have a clockwise bias and their angular contact points in notches 65 are forcing all the three seals against their mating surfaces plus the seal 61 will be forced upward, seal 171 to the right and seal 172 downward against the vane carrier $V_1$ or against the internal distributing stator DS in FIG. 26. The vertical clearance 173 between seals 61 and 171 and the horizontal clearance 174 between seals 171 and 172 permits a selfadjusting wear and expansion tolerating sealing without a high precision dimensional match. All the three springs 167 can be conveniently preassembled while the total thickness of parts 168 and 169 is providing a small working clearance for all the sealing members when they are assembled between the vane laminations and tightened by a screw 175 as previously described. In FIG. 32 the three seals on their vanes of both vane carriers are assembled in the opposite way whereby the seal 61 can again extend to a pocket on both vane carriers as described for FIG. 12.

If the model in FIG. 32 is converted to a rotating pressure chamber model like the one shown in FIG. 12, for instance, a slightly different differential gear arrangement could be used when the reversing pinions 158 are rotatably secured directly to the operating shaft OS and then the vane carrier $V_1$ can function as the right side gear 155 and the rotating pressure chamber or vane carrier $V_2$ will reach from the outside (like the bushing 150) to the left side gear 157 which is again providing the link connection to crank 84 but the crank pin $R_1$, now on vane carrier $V_2$, could be called the crank pin $R_2$ then. Even the 1:1 reversing gear design of FIG. 1 can be used here as a differential gear if gear center 18 is carried by the flywheel 86 and one or the other side gear (10 or 15) is linked to the crank 84, but the illustrated ordinary bevel-gear-type differential gear still can proved to be the most compact and suitable for the orbital crank controlled differential gear control version among the many design options.

Multistage Pressure Chambers

The peristaltic motion controlling cranks $R_1$ and $R_2$ provide a further flexibility for coupling more than two concentric vane carriers with any desired number of vanes to provide a simultaneous peristaltic stepping motion inside of adjacent stationary cylindrical main pressure chamber compartments whose number can again reach a theoretical infinity.

Figure 30:
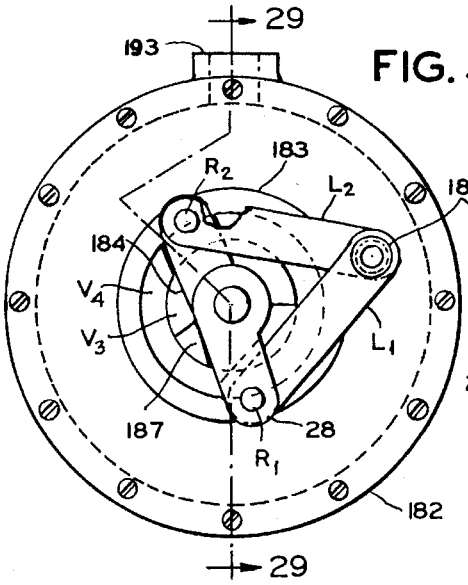
FIG. 30 is the end view of FIG. 29 with the differential linkage functioning as a connecting means between any of the control mechanisms of this invention and all the vanes in the multistage pressure chambers.
Figure 29:
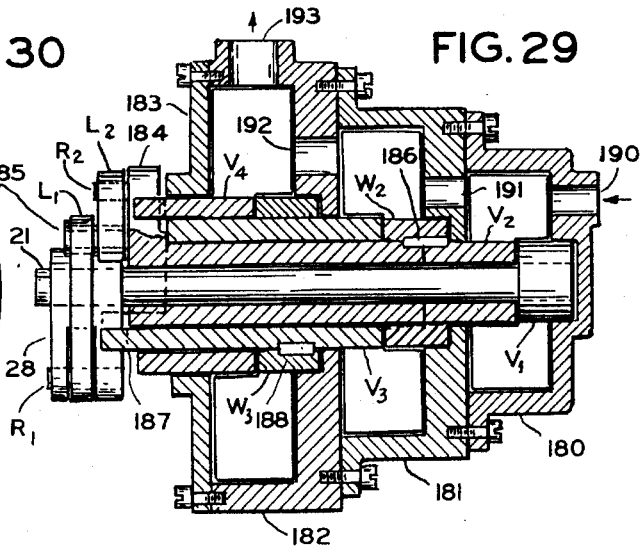
FIG. 29 is illustrating a pressure chamber sectional view for a multistage model.

In FIGS. 29 and 30 three cylindrical pressure chambers 180, 182 and 182 are shown screwed together whereby the last chamber 182 is provided with a cover plate 183 which provides a bearing hole for a largest diameter vane carrier $V_2$ while the vane carrier $V_1$ on shaft 21 has a bearing mount in the first chamber 180. The basic shape and operation of this first pressure chamber 180 is practically same as shown in FIG. 22 where the vane carrier $V_1$ is secured to shaft 21 on one end and to the crank arm 28 on the other end while the vane carrier $V_2$ is rotatably mounted to the shaft 21 and on its left end in FIG. 29 it has a crank arm 184 for the crank pin $R_2$. In FIG. 30 links $L_1$ and $L_2$ are shown pivotally connected to cranks $R_1$ and $R_2$ and also pivotally joined by a stepped bushing 185 whose bearing hole can be pivotally received by the pin 20 for following any peristaltic wave shape suited to the number of vanes on vane carriers and controlled by any method previously described.

Concentrically, telescopingly and rotatably on top of the first two vane carrier shafts as used in a one stage model, any number of hollow vane carrier shafts can be added whereby only one extra hollow shaft for each added stage is required. In FIG. 29 the vane carrier $V_2$ is coupled to a vane carrier $W_2$ in the next pressure chamber 181 by means of a 3-way connecting key 186 between the vane carriers $V_2$, $W_2$ and the hollow shaft of crank arm 184 whereby this split connection between this shaft and the vane carrier $V_2$ is shown just as one option to simplify the assembly. Basically, vane carriers $V_2$, $W_2$ and crank arm 184 work together as an integral part.

In the pressure chamber 181 a further vane carrier $V_3$ is shown rotatable on vane carrier shaft $V_2$ and having a longer shaft extension with a notch 187 to engage the crank arm 28 while on the opposite side of this notch a clearance is provided to allow a maximum 90° swinging freedom for the crank arm 184. In same manner the vane carrier $V_3$ is keyed to the vane carrier $W_3$ in the third pressure chamber 182 by means of a key 188 while in the same pressure chamber a vane carrier $V_4$, with same outside diameter as the vane carrier $W_3$, is rotatably mounted on top of the vane carrier $V_3$and having a similar notch coupling to crank arm 184 as used between crank arm 28 and notch 187. In this manner for each additional pressure chamber one more hollow vane carrier can be added for each additional stage whereby all the odd number vane carriers will be coupled to the crank arm 28 and the even number vane carriers will be coupled to the crank arm 184. This grouped coupling arrangement also means that all the odd and even number vanes in their pressure chambers are producing same angle peristaltic steps because they are moving together.

In the illustrated stationary pressure chamber configuration side or peripheral communication ports can be used. In FIG. 29 a side entrance port 190 is shown for the first pressure chamber 180 while the outlet port 191 on the other side can function also as an inlet port for the pressure chamber 181. In the same manner the outlet port 192 for the pressure chamber 181 will be the inlet port for chamber 182 which has a peripheral outlet port 193 but it is understandable that this port can be also located in the cover 183.

One of the applications for a multistage peristaltic flow is in multistage steam engines which normally require separate different size pistons in their cylinders to take advantage of the remaining energy in steam after each pressure drop. For this purpose the pressure chamber displacement volumes will be suited to this pressure drop whereby the increasing pressure chamber diameters in FIG. 29 already can provide the required volume increase. If now the bushing 185 is linked to any of the previously described peristaltic control mechanism using any suitable vane number N and also N number of inlet and outlet ports 190, 192, 192 and 193, a three stage peristaltic steam engine operation becomes possible in a very compact framework.

In the internal combustion engine class the existing piston engines are not very suitable for a multistage operation, though few attempts, called migrating engines, have been made to save some energy left in the exhaust gases, but the multistage configuration of this invention permits a very direct passage of unburnt gases from the first stage combustion chamber for further burning and an additional power pickup from the second stage. In a two-stage multichamber internal combustion engine, for instance, the port 190 will be the intake again, port 191 will be the transfer port and the port 192 will be then the exhaust port while the spark plugs or injection points can be located also on the periphery or on the side.

Further options here include a variety of hybrids like engine-pump configurations where one stage will function as an engine and the other one as a pump or in internal combustion engines one of the stages can be used for supercharging the engine section.

Also, the orbiting crank controlled differential gear method in FIGS. 31–33 can function as a peristaltic control means instead of the links $L_1$ and $L_2$. In that case the side gear 155 of FIG. 31 will be coupled to the crank arm 28, the side gear 157 with crank pin $R_2$ on the other side will have an outside tubular connection from the crank arm 184 and the reversing pinions 158 will be mounted to a shaft of the flywheel 86 as mentioned before but not illustrated in FIG. 32.

Peristaltic Step Factor, Displacement and Torque

On line 3 in the Table the nominal values for α are listed which are related to the number of vanes on each vane carrier (α=90°:N) and on line 4 these values are doubled to get a peristaltic step angle. In the geometric illustrations in FIGS. 2–4 and in all the illustrated practical embodiments this nominal value was used because it provides a 3:1 peristaltic accelerating-decelerating rotational relationship to the vane carriers in all the version which in turn means that for any vane number the sum of the peristaltic step angles is always 360° for one revolution of operating shaft OS. The value of α, however, could have a considerably wider theoretical range with a multiplying factor from 0 to 2 which means that within this range the peristaltic step value could be reduced to 0 in one extreme and multiplied to a theoretical maximum by 2 which in turn will increase the total peristaltic step degree value to 720° during a revolution of operating shaft OS. This, however, is not practically possible because the vane thickness. Still, a selected increase or decrease of the nominal α value can provide further flexibility for the basic theory and calculations. Giving now a factor value of 1 for any nominal α and designating this as a nominal peristaltic step factor P=1, any larger or smaller value of α can provide a larger or smaller peristaltic step factor when the new value for α if $\alpha_1$. Then $$P=\frac{\alpha_1}{\alpha}$$

where $\alpha_1$ has a 0 to 2α range as mentioned before.

As a practical sample, if the nominal 45°α in FIG. 2 is increased to $\alpha_1$=54°, for instance, then $$P=\frac{54°}{45°}=1.2$$

or if $\alpha_1$=36°, then $$P=\frac{36°}{45°}=.8.$$

This factor P can be used now to get a total peristaltic step degrees during a revolution for any α value: in the first case P×360°=1.2×360°=432° and in the second case P×360°=0.8×360°=288°. The multiplying factor P=1.2 is now producing a "fatter" peristaltic curve in FIG. 5 as shown in dotted lines while the reducing factor P=0.8 is resulting to a "leaner" curve as shown in phantom lines.

These theoretical extremes could be best understood when FIG. 4 is related to FIG. 5 with a 360° shaft degree scale. In FIG. 4 the center point D of the eccentric circle peristaltic wave PW is shown on the nonfunctioning control circle CC in a horizontal alignment with the 45° position cranks $R_1$ and $R_2$ which gives a 90° value to α. If now α is reduced, the point D will move closer to center A which also means that the crank circle CC will decrease until it will coincide with center A when α=0. In this extreme case there is no peristaltic step and $R_1$ and $R_2$ do not separate in FIG. 5: they both will follow the diagonal line of shaft OS.

In the other extreme when the distance AD is increased and circles CC and RC will coincide, the links $L_1$, $L_2$ and $L_3$ will have same length and then α will be 180°. In FIG. 5 this means first no motion to crank $R_2$ and a 180° motion to crank $R_1$ and during the following 180° rotation of crank $L_3$ the opposite will happen. While the theoretical P=2 is not practically possible, a P value between 1 and 2 could be still useful: for FIGS. 26–28 if P=1.2 is used, for instance, it will increase the 180° peristaltic step on shaft OS to 216° and on shaft $OS_1$ to 54° and then the eight peristaltic steps will multiply to a 432° peristaltic volume change during a revolution of the power output shaft $OS_1$ in this model.

In FIG. 2 same extremes can be demonstrated: if P=2, same elliptical peristaltic control wave PW can be used when the length of crank arms $R_1$ and $R_2$ from the center A are reduced (by a factor of about 0.6) and the new α=90° is equally divided about the horizontal center line like in FIG. 4, then a theoretical 180° peristaltic step will be created, but in the other extreme, if the elliptical wave PW is changing to the size of the inner circle IC, P will be 0 and there will be no peristaltic step.

In all the variable volume devices (engines, pumps etc) a volumetric change or displacement value is used as a measuring stick which in automotive industry is known as a total volumetric change in all the cylinders. This displacement volume value could be used now as an approximate comparisson between the ordinary piston engines and the peristaltic rotary engines but then the automotive displacement figure has to be reduced to half as a per revolution figure because the complete Otto-cycle requires 2 shaft revolutions in linear piston engines. Therefore a comparative displacement volume V in peristaltic rotary engines when P=1 is the volume determined by the inside diameter D of the main pressure chamber, the diameter d of the vane carrier $V_1$ and the width or length L of a pressure chamber: $V=0.785\ (D^2=d^2)L$.

If now the peristaltic step factor P is not 1 and if the displacement factor F from lines 10 and 11 in the Table is more than 1 for higher N values, these two factors will be added and then $V=0.785\ (D^2-d^2)LPF$ whereby the multiplying factor F in larger models with more vanes is an indicator for an increase compactness and power. Since P can be also expressed as $$\frac{4N\alpha}{360°}$$

for any value of α, it can be used as a substitute for P and then the displacement volume equation will be $$V=\frac{NLF\alpha(D^2-d^2)}{360°}$$

without the factor P.

In liner piston engines a linear pressure indicator diagram is used for determining the mean effective pressure (m.e.p) which can be used then for further torque and horsepower calculations. For a rotary peristaltic engine a similar but arcuate pressure indicator diagram can be used as shown in FIG. 35 where a 90° peristaltic step scale is shown with a 0–400 PSI pressure scale and where only a pressure curve 195 and a compression curve 196 are illustrated. Using now the pressure area division method the mean effective pressure arc 197 is shown in phantom lines indicating a 110 PSI figure. Since in peristaltic engines the pressure is applied directly against the surfaces of the vanes, the arc 197 is carried further against the vane $V_2$ in an improvised pressure chamber compartment including the second vane $V_1$ and the inner and outer compartment walls r and R. If now the equal are pressure distribution method is used to determine the moment arm M for the 110 PSI pressure according to an equation $$M\sqrt{\frac{R^2-r^2}{2}+r^2},$$

the torque can be calculated if the vane area is known.

For a sample case if R=4" and r=1.5" then M will be 3" and if L=1.6" the vane area will be 2.5×1.6=4 $IN^2$ and now the torque will be $$\frac{110\times3\times4}{12}=110\text{ ft.-lb.}$$

which means in this size proportion the torque will equal the m.e.p. Further, since in a 4000–5000 RPM speed range the torque and HP values are about equal, the illustrated case with a 8" dia main pressure chamber, with a 3" dia vane $V_1$ and a 1.6" pressure chamber width can have a 110 ft.-lb. torque and a 110 Hp rating as a theoretical figure. In this 4-vane internal combustion engine F and P are 1 and then $V=0.785(8^2-3^2)\times1.6=69\text{ in}^3$ which has to be doubled to 138 $in^3$ (2260 cc) for linear piston engine comparisson.

If the vanes $V_1$ and $V_2$ in the chamber of FIG. 35 are in the "dead center" position, the internal pressure cannot start a motion similarly to the linear piston engines but just past of this position the differential power transmission linkup means controlled acceleration-deceleration will allow a motion differential which can start the rotation of the output shaft OS. In the actual higher speed operation, however, the kinetic energies in all the rotating members are a very important factor for a smooth rotation. Also, after each dead center position the reverse pressure, which is applied to the decelerating vane, is really applied against a kinetic energy and then the peristaltic motion controlled harmonic-motion-like deceleration without hard stops about coincides with the pressure-against-kinetic-energy-type deceleration which in turn means that the peristaltic motion control gear does not have to carry the full power transmission torque.

Internal Combustion Engines

Some of the internal combustion engine features and requirements were previously mentioned in FIGS. 17 and 22 but a 5-step Otto-cycle operation is schematically and successively illustrated in FIG. 367 for a 4-vane spark ignition model whose displacement factor is 1 as found on line 11 in the Table. A starting vane position is shown on the upper left in FIG. 36 where the vane carrier $V_1$ with its shaft 21 has two vanes 23 and 25 while the vane carrier $V_2$, as a concentric rotating pressure chamber, has vanes 22 and 24 as previously described for most variations. The inlet port 95 and the exhaust port 96 are shown as being on a stationary side distributing stator which includes the spark plug 97. Vanes 22 and 23 have a dot marking for visibly following their rotation through the next four steps in a CW direction.

The first peristaltic step will accelerate the vane 22 135° and decelerate the vane 23 45° with a resulting 90° volume increase which is causing a suction of air-fuel mixture from the inlet port 95 to fill the enlarged volume subchamber 200. In the third position the vane 23 has accelerated 135° and vane 22 decelerated 45° and since there are no communicating ports in this section a fuel mixture compression takes place and spark ignition can follow. Only an ignition coil 202 with its contacts 203, a camming point 204 and a wire connection to the spark plug 97 are shown schematically because this is a common practice with numerous other possibilities. The four camming points 204 for contacts 203 with a 45°–135° spacing can provide same ignition timing as four equally spaced ignition generating points on the uniform motion output shaft OS. In this position the compressed air-fuel mixture will be spark ignited and the resulting explosive power will increase the volume 201 to the fourth position volume 205 which means this power stroke provides the 135°–45° motion differential for rotating the output shaft OS also 90° in a clockwise direction. Just before the end of this power stroke the exhaust port 96 will be uncovered by vane 22 and the exhaust starts. In the fifth position the vanes 22 and 23 are shown in a position just before the first position where the exhaust is almost completed by the 135° rotation of vane 23 against the 45° rotation of vane 22 which will reduce the maximum volume in this subchamber to the minimum volume 206 as shown in the last position.

In internal combustion engines it is desirable to compress the air-fuel mixture to a level most suitable for a used fuel for getting a most efficient performance. In spark ignition engines an average compression ratio is 9 which is schematically shown as a 10° to 90° relationship in FIG. 35 or in practice this is the maximum and minimum volumetric ratio between all the adjacent vane pairs in their widest and closest position. For Diesel engines with different fuels the ignition comes from the high compression ratio of about 12–18 which basically means a reduction of the smallest subchamber volumes between adjacent vanes by making the vanes thicker or just increasing the peristaltic step factor P slightly.

In FIG. 37 an 8-vane internal combustion engine model (fourth column in the Table) is schematically illustrated where α=22.5° and then there will be eight 45° double acting peristaltic steps during a revolution. This model requires two spark plugs 97A or ignition points whereby the ignition can be generated by 8 camming points 204 with a 22.5° and 67.5° spacing on the periphery of the rotating vane carrier $V_2$ again. There are also two inlet ports 95 and two exhaust ports 96 in an opposing position. The Otto-cycle operation or sequence for this model is practically same but the one revolution cycle of FIG. 36 will take place now within 180° which means that there are now 8 double acting 45° power strokes during a revolution of the output shaft OS. The advantage in this version is that the displacement factor F (line 10 in the Table) will double the active displacement volume and the opposing power strokes are completely removing the pressure from the shaft bearings.

If the illustrated 8-vane external pressure model (steam) of FIGS. 27–29, where the displacement factor F is 4, is converted to an Otto-cycle operation with 2 inlet and 2 exhaust ports and also with 2 spark plugs or injection points on the internal distributing stator DS, the required 8 ignition contact points for the parallel connected 2 spark plugs can be generated and timed by a 2-lobe camming taken from the collar 126 in FIG. 27 because the 4:1 gear ratio will multiply this to the required 8 ignition points spaced 45° apart as briefly mentioned before.

The one subchamber Otto-cycle sequence in FIG. 36 is also shematically shown in the left section of FIG. 38 where two 180° peristaltic motion curves of FIG. 5 are doubled for a full 360° shaft revolution and where 200 designates again the intake chamber 90° expansion. Next, 201 will be the 90° compression which is followed by a spark or compression (diesel) ignition point 207 to start the 90° power stroke 205 and then the 90° volume reduction or exhaust stroke 206 can follow.

In a peristaltic engine, however, all the increasing and decreasing subchamber volumes between adjacent vanes are fully active and provide a staggered arrangement which is fully shown in FIG. 38 where only the ignition point 207 and a schematically shown power stroke arrow 208 is shown to illustrate the four 90° power strokes in a staggered succession during a full revolution of the output shaft OS.

If this illustration is converted to an external pressure operation, the expanding subchambers 200 and 205 both are functioning as power strokes and this will agree now with the displacement factor F=2 in the second column on line 11 in the Table.

Thus FIG. 38 demonstrates that for the 4-vane internal combustion engines there are four 90° power strokes (if P=1) during a revolution while for external pressure engines there are four double power strokes (720°) during one revolution of the output shaft OS. In pumping applications again, when shaft OS functions as the power input shaft, subchambers 200 and 205 will function as suction chambers while chambers 201 and 206 are forcing the fluid out through the outlet ports 27 (FIG. 1) whereby the fluid output pressure will be determined by the power input torque of shaft OS.

Through the peristaltic step factor P=1 can satisfy most requirements, a higher P value (1.2 in FIG. 5, for instance) can increase the volumetric output which may be desirable in slower speed pumping operations. A lower P value, which provides a leaner peristaltic motion curve, could be preferable for high speed internal combustion engines for an extra smooth rotation. A change from P=1 to P=0.8, for instance, will reduce the displacement volume but because of the very compact nature of peristaltic engines, a small increase of the main pressure chamber diameter D or the length L to compensate for the P reduction is hardly noticeable.

For starting an internal combustion engine the minimum starting rotation is only 180° (360° in linear Otto-cycle engines) and any conventional manual or motorized starting method can be used here. An external pressure engine (steam etc) can be started without any help when the vanes are not in the dead center position but with two phased engines self starting is possible like in locomotives. Reversing can be accomplished by switching the input and output ports.

Conclusion

Besides the selected most typical illustrated design options, the orderly mathematical progression in the Table of FIG. 6 supports the complete kinematic theory together with four geometric illustrations in FIGS. 2–3 and 31 where the peristaltic wave PW in few different shapes appears as the backbone of this invention whereby the radial rotating motion BC for pont B makes possible to use four or five different "control building blocks" in the control section which can be coupled to two vane carriers $V_1$ and $V_2$ in the pressure chamber section where the stationary main pressure chambers can have a side or peripheral distributing stator and the rotating pressure chambers (vane carriers $V_2$) can have a side or internal distributing stator DS.

In all cases the noncircular or eccentric circular peristaltic vawe PW can establish the synchronization reference line because the control stator CS can support a second parallel control axis or it can include a peristaltic cam profile or an internal control gear. The limited angle differential linkup means again can be a differential linkage or gear which can control the vane accelerations and decelerations for peristaltic stepping. While the illustrate methods look somewhat different, they create exactly same end result (the curve in FIG. 5) and all of them can also be used to control the peristaltic vane motion in multi-stage pressure chambers.

As listed on lines 6–9 in the Table, the peristaltic wave shape can be generated by the central reverse or unidirectional crank control, by the orbiting crank control, by the linkage of FIG. 4 directly or with a geared down version and finally all the peristaltic wave shapes on line 5 can be directly cam generated as shown in FIG. 23 for the elliptical shape. Further, the orbiting crank control is very suitable for a direct one link connection to one of the three members of a differential gear which also has a limited angle oscillating operation like the differential linkage.

While practically nay tabulated version in the control section can produce same peristaltic motion curve of FIG. 5 to provide a smooth harmonic-motion-like peristaltic vane motion using concentric axially balanced components in the pressure chamber section, another important requirement in rotary engines is to provide leaktight pressure chambers. The sealing has been the most difficult problem in rotary engines and even in the most successful Wankel engine the 22-member sealing grid is still one of its remaining serious problems and therefore in the present invention the 4–12 sealing members in different models in a simple cylindrical main pressure chamber can be viewed as an import improvement in all the illustrated main pressure chamber configurations besides the further compactness or an increased power to size ratio. Because of the somewhat similar rotary engine construction to Wankel engines, all the previously listed other advantages (page 1) are applicable to peristaltic engines of this invention.

For a compactness comparisson in a large engine class a two stroke 12 cylinder radial engine from Encyclopedia Britannica is selected where each of the 14" diameter pistons has a 16" power stroke once during a revolution and then the total displacement volume will be $12\times0.785\times14^2\times167=29,541$ in$^3$. The enclosure volume for this 400 RPM 2125 HP vertical shaft engine is 692 ft$^3$ (14 ft dia. and 54" high).

In a double acting 8-vane Otto-cycle peristaltic rotary engine, with P=1 and F=2, the same displacement volume V is achievable when D=42", d=14" and L=12". Then according to the previously explained equation $V=0.785\ (42^2-14^2)12\times2=29,541$ in$^3$. If now an enclosure size with a 48" dia. and 33" length is used for this peristaltic engine, the volume will be 34.5 ft$^3$ which is about 20 times smaller than the 692 ft$^3$ volume of the 12-cylinder linear piston engine.

The large volumetric throughput and an attractive power to size ratio becomes even more apparent in a very large engine class with a high vane number N. In a 16-vane model, for instance, which is not listed in the Table anymore, N will be 8 and then all the other values can be readily calculated: $\alpha=90°:8=11.25°$, the peristaltic step will be 22,5° , the peristaltic wave will be octagon based and if the linkage control of FIGS. 26 and 28 is used, the gear ratio on line 9 in the Table will be 8:1 between the shaft OS and the vane carriers or shaft $OS_1$ and in internal combustion engines F will be 4 and now for spark ignition the collar 126 in FIG. 26 can still function as a 2-lobe spark generator to provide the required 16 sparks for all the four parallel connected spark plugs during a revolution of the output shaft OS.

If now for this engine D=6 ft, d=2 ft and L=2 ft, for instance, and the m.e.p is again 110 PSI, using the previously explained equations, the moment or torque arm M=2.24 ft the vane area will be 4 $ft^2$=576 $in^2$ and then the torque will be 110×2.24×576=141,926 ft.-lb. which can give a rather high HP rating even in slower speeds (2700 HP for 100 RPM) but a larger rotary engine without reciprocating masses can well work in a considerably higher speed range to produce higher HP ratings. The displacement for this 16-vane internal combustion engine if P=1, will be $V=0.785(6^2-2^2)\times2\times4=$ 201 $ft^3$ but for steam or pumping models F will be 8 and then V=402 $ft^3$ per shaft revolution which is a very high figure as compared to existing considerably larger piston engines. This 16-vane model has a smaller 22.5° peristaltic step but on its 72" pressure chamber periphery the peristaltic step is still 14" with a 3.2 $ft^3$ peristaltic volume change.

For differential gear models the rotational balancing was described for FIG. 32 but for differential linkage higher speed models an opposing radially moving counter balancing weight could be used or the linkage components $L_2$, $L_2$ and the lever 19 could be doubled on the opposite side which in addition to a fully counter balanced condition can also double the power transmission strength in some models.

Because of the central axis or concentric design the peristaltic engines are comparable to electric motors where even the appearance, many operating modes, different vane numbers, reversibility, very wide size and power range and a stationary to rotary commutation have a basic similarity but even the rotation causing magnetic attraction is comparable to the directly applied pressure against a vane surface. The larger models again with a multiport multivane operation have a resemblance to turbines but with the exception that the peristaltically functioning subchambers have a positive displacement which makes possible a slow speed operation which again permits a direct propeller drive in marine applications, for instance.

It is to be understood again that the different illustrated and tabulated configurations are functioning as "building blocks" which can be assembled in many different combinations and sizes to suit different manufacturing methods and material preferences most suitable for a large variety of applications and operating conditions which will include vehicular engines of any kind whereby the peripheral, side or internal distributing stators DS with different communication hole patterns are suited to the selected vane numbers and displacement factors F as required for pumping, external pressure or internal combustion models where a variety of existing accessories for fuel input, ignition and diesel operation can be readily used.

Thus all the selected illustrations in this invention include the peristaltically controlled alternately accelerating and decelerating vanes for creasing the peristaltic flow for many different purposes. It is to be understood also that all the listed options which are supported by the mathematical equations can be easily put in a practical use by those skilled in the art. Therefore we do not intent to be limited to the details shown and/or described but rather intend to cover all changes and modifications encompassed within the scope of the appended claims.

We claim:

1. A peristaltic vane controlling device for a central-axis rotary variable volume pressure chamber supported by a base member (30), comprising:

an operating shaft OS), including an operating crank arm;

a first rotor with a crank arm ($R_1$), including first vanes on a first vane carrier ($V_1$) and first power transmission linkup means;

a second rotor with a crank arm ($R_2$), including second vanes on a second vane carrier ($V_2$) and second power transmission linkup means;

a control stator (CS) with a reference line effecting a revolving radial oscillating control motion by means of a control point (B) following a peristaltic control wave (PW);

a distributing stator (DS) including a pattern of inlet and outlet ports related to a reference line;

a cylindrical main pressure chamber divided to revolving variable volume subchambers between said first and second vanes whereby said subchambers being in a communicating contact with a surface on said distributing stator;

a differential power transmission linkup means providing a limited angle differential connection between said operating shaft and said first and second rotors whereby said peristaltic wave is effecting a peristaltic motion with a number of peristaltic volume changes in a form of alternate accelerating and decelerating rotation of said first and second vanes to occur more than once during a revolution of said operating shaft; and a registry between said reference lines on said control stator and on said distributing stator providing a synchronized communicating relationship between said revolving subchambers and said distributing stator for effecting a peristaltic flow of fluids through said inlet and outlet ports for any useful purpose.

2. A peristaltic vane controlling device of claim 1 wherein said differential power transmission linkup means being a four-bar-linkage without a base link instead of which said control point being one of the pivot points on said four-bar-linkage following said peristaltic control wave for producing said radial oscillating control motion.

3. A peristaltic vane controlling device of claim 2 wherein said oscillations for said control point being generated by a noncircular cam on said control stator with said reference line related to and established by the noncircular shape of said cam.

4. A peristaltic vane controlling device of claim 2 wherein said oscillating control motion for said control point being provided by an eccentrically rotating control crank whereby said peristaltic wave being an eccentric circle producing two oscillations during a revolution of said operating shaft; said first and second power transmission linkup means for said first and second rotors being central-axis crank arms with connecting links to said control point; said reference line being drawn through said central axis and through the center of said eccentric control crank and said peristaltic volume changes occuring only twice during one revolution of said operating shaft.

5. A peristaltic vane controlling device of claim 2 wherein said oscillating control motion for said control point being provided by an eccentrically rotating control crank whereby said peristaltic wave being an eccentric circle producing two oscillations during a revolution of said operating shaft; said first and second power transmission linkup means for said first and second rotors being central-axis crank arms with connecting links to said control point; said reference line being drawn through the center of said central axis and through the center of said eccentric control crank whereby said main pressure chamber with said first and second vane carriers with N number of vanes each being on a third parallel axis and said first and second rotors having a reduction gearing with a N:1 reduction to reduce the nominal 180° peristaltic steps on said first and second rotors N time to produce 2N number of said volume changing peristaltic steps during a revolution of said operating shaft.

6. A peristaltic vane controlling device of claim 2 wherein said oscillating control motion for said control point being provided by a central control crank concentric with said operating shaft but having a speed changing gear connection from said operating shaft whereby said control stator is supporting a second parallel axis for a speed changing gear and said parallel axis is establishing said reference line on said control stator.

7. A peristaltic vane controlling device of claim 6 wherein said speed changing gear is providing a reversed different speed for said central crank whereby the gear ratio between said control crank and said operating shaft being (N−1):1 when N is the number of vanes on each of said vane carrier.

8. A peristaltic vane controlling device of claim 6 wherein said speed changing gear is providing a unidirectional different speed for said central crank whereby the gear ratio between said control crank and said operating shaft being (N+1):1 when N is the number of vanes on each of said vane carrier.

9. A peristaltic vane controlling device of claim 1 wherein said peristaltic wave for controlling said differential linkup means is being generated by an orbiting crank or an orbiting gear which is in mesh with a stationary internal gear whereby this meshing gear pair is functioning as said control stator while the orbiting crank generated noncircular shape of said peristaltic wave is determining said reference line on said control stator, and said orbiting gear and said internal gear having a gear ratio N:1 when N is the number of vanes one each of said vane carriers and said gear ratio is determining the shape of said peristaltic wave for proving 2N oscillations and 2N peristaltic steps during a revolution of said operating shaft.

10. A peristaltic vane controlling device of claim 9 wherein said differential linkup means being a rotating four-bar-linkage without a base link but one of its pivot points having a direct connection to said orbiting crank and said 2N oscillations are producing 2N peristaltic volume changes in said main pressure chamber during a revolution of said operating shaft for each of said subchamber.

11. A peristaltic vane controlling device of claim 9 wherein said differential linkup means being a rotating four-bar-linkage without a base link but one of its pivot points having an indirect connection to said orbiting crank by means of a connecting link from said orbiting crank and a lever on said operating crank arm and said 2N oscillations are producing 2N peristaltic volume changes for each of said subchambers in said main pressure chamber during one revolution of said operating shaft.

12. A peristaltic vane controlling device of claim 9 wherein said differential linkup means being a limited angle differential gear whereby one of its three shafts having a link connection to said orbiting crank for transferring the orbiting crank generated oscillations to said differential gear whereby said N:1 gear ratio is producing 2N oscillations and 2N peristaltic subchamber volume changes in said main pressure chamber during a revolution of said operating shaft.

13. A peristaltic vane controlling device of claim 9 wherein said differential linkup means being a limited angle bevel-gear-type differential gear whereby one of the side gears of said differential gear has a link connection to said orbiting crank for transferring the orbiting crank generated oscillations to said side gears and whereby one of said side gears is linked to said first vane carrier, the other of said side gears is linked to said second vane carrier and the reversing bevel gears are rotatably linked to said operating shaft whose uniform rotation is divided by the peristaltic wave generated oscillations of said orbiting crank to an alternately accelerating and decelerating rotation of said vane carriers; and whereby said N:1 gear ratio is producing 2N oscillation and 2N peristaltic volume changes in said main pressure chamber during one revolution of said operating shaft.

14. A peristaltic vane controlling device of claim 1 wherein said peristaltic wave having an elliptical shape producing four of said radial oscillating motions during a revolution of said operating shaft; and said first and second vane carriers having two vanes each producing four of said peristaltic step caused volume changes in said subchambers during a revolution of said operating shaft.

15. A peristaltic vane controlling device of claim 1 wherein said cylindrical main pressure chamber being a stationary section of said base member while said first and second vane carriers, each with N number of peristaltically rotating vanes, are working in said main pressure chamber whereby any stationary section of said main pressure chamber is functioning as said distributing stator for providing said communicating hole pattern for said inlet and outlet ports.

16. A peristaltic vane controlling device of claim 1 wherein said cylindrical main pressure chamber being a peristaltically rotating member functioning as said second vane carrier concentric with said first vane carrier with N number of peristaltically rotating vanes each which are in a communicating relationship with said hole pattern on said distributing stator which is functioning as a stationary side surface on said rotating main pressure chamber.

17. A peristaltic vane controlling device of claim 1 wherein said cylindrical main pressure chamber being a peristaltically rotating member functioning as said second vane carrier concentric with said first vane carrier with N number of peristaltically rotating vanes each which are in a communicating relationship with said hole pattern on said distributing stator which is functioning as an internal cylindrical surface next to said first vane carrier.

18. A peristaltic vane controlling device of claim 1 wherein each of said vane carriers has N number of vanes and sad hole pattern on said distributing stator has N number of inlet ports and N number of outlet ports in a peristaltic communication with said N number of vanes on each of said vane carrier and said operating shaft is power rotated to create a peristaltic pumping circulation of fluids through said inlet and outlet ports.

19. A peristaltic vane controlling device of claim 1 wherein each of said vane carriers has N number of vanes and said hole pattern on said distributing stator has N number of inlet pots and N number of outlet ports in a peristaltic communication with said N number of vanes on each of said vane carrier and an external fluid pressure is directed to said N number of inlet ports to apply a peristaltic rotation causing pressure between said N number of vanes to cause a peristaltic power transmission and a uniform rotation to said operating shaft which is functioning as a power output shaft of a peristaltic external pressure engine.

20. A peristaltic vane controlling device of claim 1 wherein each of said vane carriers has N number of vanes and said hole pattern on said distributing stator has N:2 number of inlet ports, N:2 number of exhaust ports and N:2 number of ignition points in a peristaltic communication with said N number of vanes on each of said vane carrier to provide a 4-step Otto-cycle operation including intake, compression, ignition, the power stroke and an exhaust stroke between said N number of vanes whereby said power strokes are occuring 2N times during one revolution of said operating shaft and said power strokes are causing a peristaltic power transmission and a uniform rotation to said operating shaft which will function as a power output shaft of a peristaltic internal combustion engine.

21. A peristaltic vane controlling device of claim 1 wherein said first and second vanes have a rectangular shape and a clearance fit in said main pressure chamber whereby said vanes on said vane carriers have grooves for spring loaded sealing members to force them against their mating moving surcaces for a leaktight contact.

22. A peristaltic vane controlling device of claim 21 wherein said sealing members have overlapping and stepped corner joints for proving a small leaktight adjusting motion to compensate for dimensional inaccuracies, wear and thermal expansion.

23. A peristaltic vane controlling device of claim 1 wherein said N number of vanes on said first and second vance carrier have a circular shape and a clearance fit in said main pressure chamber, which has a toroidal shape, whereby said vanes have mating groove for split piston-ring-type sealing members which have a spring bias against their mating moving surfaces in said toroidal main pressure chamber for providing a leaktight fit.

24. A peristaltic vane controlling device of claim 1 wherein said second vane carrier being a rotating main pressure chamber including angular cooling fins on its outside surface to provide a cooling air flow for internal combustion engines.

25. A peristaltic vane controlling device of claim 1 wherein more than one of said cylindrical main pressure chambers have a concentric arrangement next to each other whereby each of said added pressure chamber includes an additional first and second vane carrier on concentric telescoping shafts and whereby all of said first vane carriers are linked to said first power transmission linkup means and said second vane carriers are linked to said second power transmission linkup means for a unisonous peristaltic motion for creating a multistage peristaltic flow of fluids from the first pressure chamber to the added pressure chambers in any desired order and combination for creating a multistage peristaltic volume change for any desired application.

26. A peristaltic vane controlling device of claim 1 wherein the relationship of said reference lines on said control stator and said distributing stator is adjustable to provide an adjustment between the peristaltic vane motion inside said main pressure chamber and said communicating hole pattern on said distributing stator.

* * * * *

UNITED STATES PATENT AND TRADEMARK OFFICE

CERTIFICATE OF CORRECTION

PATENT NO. : 5,501,182

DATED : March 26, 1996

INVENTOR(S) : Leo Kull

It is certified that error appears in the above-indentified patent and that said Letters Patent is hereby corrected as shown below:

| Column -line | As printed | Correct |
|---|---|---|
| 1-43 | eternally | externally |
| 1-49 | 5,086 | 5,086,732 |
| 1-55 | 1,003,80 | 1,003,800 |
| 2-3 | shaft | shape |
| 2-8 | know | known |
| 8-34 | ear | gear |
| 8-49 | bane | vane |
| 10-32 | patch | pitch |
| 11-27 | shown | show |
| 11-51 | pots | ports |
| 12-64 | basis | basic |
| 13-1 | 78 | 7 |
| 14-47 | his | this |
| 16-28 | 2 | 26 |
| 17-1 | PW, | $PW_1$ |
| 17-12 | 3). | 31). |
| 18-55 | can | cam |
| 18-58 | with | without |
| 19-33 | for | but |
| 19-67 | 111 | 112 |
| 20-41 | with | will |

UNITED STATES PATENT AND TRADEMARK OFFICE

CERTIFICATE OF CORRECTION

PATENT NO. : 5,501,182

DATED : March 26, 1996

INVENTOR(S) : Leo Kull

It is certified that error appears in the above-indentified patent and that said Letters Patent is hereby corrected as shown below:

| Column -line | As printed | Correct |
|---|---|---|
| 22-42 | 165 | 162 |
| 23-48 | proved | prove |
| 23-66 | $V_2$ | $V_4$ |
| 26-60 | $\ldots(D^2=d^2)L$ | $\ldots(D^2-d^2)L$ |
| 26-66 | increase | increased |
| 27-7 | $V=\frac{NLF\alpha(D^2-d^2)}{360^\circ}$ | $V=\frac{NLF\alpha(D^2-d^2)\pi}{360^\circ}$ |
| 27-25 | are | area |
| 27-30 | $M\sqrt{\ldots\ldots}$ | $M=\sqrt{\ldots\ldots}$ |
| 27-42 | vane | vane carrier |
| 28-2 | 367 | 36 |
| 30-18 | illustrate | illustrated |
| 30-32 | nay | any |

UNITED STATES PATENT AND TRADEMARK OFFICE

CERTIFICATE OF CORRECTION

PATENT NO. : 5,501,182

DATED : March 26, 1996

INVENTOR(S) : Leo Kull

It is certified that error appears in the above-indentified patent and that said Letters Patent is hereby corrected as shown below:

| Column -line | As printed | Correct |
|---|---|---|
| 30-55 | ...x167=... | ...x16=.., |
| 31-33 | $L_2$,$L_2$ | $L_1$,$L_2$ |
| 31-66 | creasing | creating |
| 34-54 | sad | said |
| 34-63 | pots | ports |
| 35-31 | vance | vane |

Signed and Sealed this

Twenty-second Day of October, 1996

*Attest:*

Bruce Lehman

BRUCE LEHMAN

*Attesting Officer*

*Commissioner of Patents and Trademarks*